United States Patent [19]

Sekido et al.

[11] Patent Number: 4,936,186

[45] Date of Patent: Jun. 26, 1990

[54] METHOD OF AND APPARATUS FOR WEAVING A THREE-DIMENSIONAL ARTICLE

[75] Inventors: Toshihide Sekido; Masafumi Ogasawara, both of Otsu, Japan

[73] Assignee: Toray Industries Inc., Tokyo, Japan

[21] Appl. No.: 291,957

[22] Filed: Dec. 29, 1988

[30] Foreign Application Priority Data

Dec. 29, 1987 [JP] Japan ..... 62-336193

[51] Int. Cl.[5] ..... D04C 3/00; D04C 1/06

[52] U.S. Cl. ..... 87/8; 87/1; 87/5; 87/11; 87/28; 87/30; 87/33

[58] Field of Search ..... 87/1, 5–9, 87/11, 28, 30, 33, 34; 139/11, 13 R, 16

[56] References Cited

U.S. PATENT DOCUMENTS

| | | | |
|---|---|---|---|
| 3,426,804 | 2/1969 | Bluck | 87/33 X |
| 4,312,261 | 1/1982 | Florentine | 87/33 |
| 4,614,147 | 9/1986 | Vendramini | 87/8 X |
| 4,621,560 | 11/1986 | Brown et al. | 87/8 |
| 4,719,837 | 1/1988 | McConnell et al. | 87/33 X |
| 4,779,429 | 10/1988 | Banos | 66/83 |
| 4,800,796 | 1/1989 | Vendramini | 87/8 X |

FOREIGN PATENT DOCUMENTS

| | | |
|---|---|---|
| 61-1538 | 1/1986 | Japan . |
| 62-230635 | 9/1987 | Japan . |
| 63-28942 | 2/1988 | Japan . |
| 63-50553 | 3/1988 | Japan . |
| 63-60738 | 3/1988 | Japan . |
| 63-66357 | 3/1988 | Japan . |
| 63-66358 | 3/1988 | Japan . |
| 63-66359 | 3/1988 | Japan . |
| 63-85849 | 4/1988 | Japan . |
| 63-112749 | 5/1988 | Japan . |
| 1356524 | 6/1974 | United Kingdom . |

OTHER PUBLICATIONS

Frank K. Ko; "Developments of High Damage Tolerant, Net Shape Composites Through Textile"; 1985; pp. 1201–1210.

Dr. Robert Adolph Florentine; "Low-Cost High Performance Structural Composite Shapes-The Magnaweave I-Beam"; 1982; pp. 1–3.

Dr. Robert Adolph Florentine; "Magnaweave and Pultrusion"; pp. 2–5.

*Primary Examiner*—John Petrakes

*Attorney, Agent, or Firm*—Oblon, Spivak, McClelland, Maier & Neustadt

[57] ABSTRACT

A method of weaving a three-dimensional article by which, an area arranging carrier members (1) in the form of a matrix is segmented into a plurality of rectangular blocks (G1 to G6) to choose prescribed blocks therefrom, and then a basic weaving operation is sequentially and alternately performed with respect to the prescribed blocks. According to the weaving method, it is possible to easily weave many kinds of three-dimensional articles (2) having different sectional forms. An apparatus for weaving a three-dimensional article having, first guide means (16) for guiding the movement in row direction of the carrier members (1) and second guide means (17) for guiding the movement in column direction of the carrier members (1), so that the carrier members (1) are smoothly moved in the row and the column directions by the first and the second guide means (16 and 17).

13 Claims, 37 Drawing Sheets

METHOD OF AND APPARATUS FOR WEAVING A THREE-DIMENSIONAL ARTICLE

BACKGROUND OF THE INVENTION

1. Field of the Invention

The present invention relates to a method of and an apparatus for weaving a three-dimensional article from a plurality of fibers with weaving means having a plurality of carrier members.

2. Description of the Background Art

For the purpose of reinforcing plastic, metal and the like, a method has been employed in which a plurality of prepregs, which are formed into plane-forms by reinforcing fibers such as carbon fiber, glass fiber, metallic fiber and the like, are laminated to be a multilayer, and then the laminated prepregs are buried into a material to be reinforced, for example a plastic material.

However such a conventional reinforcing method has the following disadvantages: Since fibers of the reinforced article are not arranged in three-dimensional direction, it is comparatively difficult to use a large quantity of reinforcing fibers, and the strength of the reinforced article can not be sufficiently improved because of low shear strength between fiber-layers arranged in the plane-forms.

To solve the above disadvantages, a method of reinforcing plastic, metal and the like, has been proposed by using what is called "a three-dimensional article" such as a braid or a braided article made by improving the braid.

A method of weaving the three-dimensional article is disclosed in the specification of U.S. Pat. No. 4,312,261. The weaving method is of a kind called the torsion lace method.

In the weaving method, a plurality of carrier members loaded with bobbins are arranged in the form of a matrix within a limmited plane. Each carrier member has magnets on the side surfaces thereof, and a plurality of electromagnetic solenoids are provided at the peripheral part of the limmited plane for the purpose of driving the carrier members. The carrier members are moved by the electromagnetic solenoids per line of carrier members along a row direction or a column direction in order to relatively change the position of the bobbins, so that fibers are intertwined with each other to form a three-dimensional article.

In the above weaving method, when a three-dimensional article having a special sectional form such as L-type, I-type, C-type and the like is woven, the carrier members are arranged in the form corresponding to the special sectional form, while a plurality of electromagnetic solenoids making up a carrier member driver are arranged along the periphery of the carrier members, and then the carrier members are alternately moved along the row and column directions per line of carrier members to weave a three-dimensional article. In such a weaving method, however, whenever the sectional form of the three-dimensional article changes, it is required to change the layout of the carrier member drivers. Further, when a three-dimensional article having a complicated sectional form such as a hollow-type and the like is woven, it is difficult to layout the carrier member drivers.

We proposed a weaving apparatus capable of industrially producing in high-speed a large-sized three-dimensional article in Japanese Patent Laying-Open Gazette No. 50553/1988. According to the weaving apparatus, since a plurality carrier members are individually driven by drivers such as linear motors and the like, it is possible to weave many kinds of three-dimensional articles having different sectional forms by using only one apparatus, thus the above problem can be solved. In such a weaving apparatus, however, it is required to provide expensive drivers such as linear motors and the like per individual carrier members, so that a facility cost and a running cost increase extremely.

On the other hand, the other weaving apparatus employing the torsion lace method is disclosed in U.S. Pat. No. 3,426,804.

In the weaving apparatus, a plurality of carrier members passing through fibers are arranged in the form of a matrix, and carrier member drivers having cam mechanisms are provided at the peripheral part of the carrier members for the purpose of driving the carrier members. The carrier members are moved by the carrier member drivers per line of carrier members along a row direction or a column direction in order to change the relative position of the carrier members, so that the fibers are intertwined with each other to form a three-dimensional article.

In the above weaving apparatus, however, each line of carrier members is moved along the surfaces of an adjacent line of carrier members, and therefore, when a certain line of carrier members are arranged so unevenly that the surfaces thereof may be irregular, it is difficult to cause the adjacent line of carrier members to move because the movement thereof is limited by the irregular surfaces.

In particular, the carrier members arranged on the same lines change whenever the carrier members alternately move in the rectangular two directions, and therefore it is not easy to cause each line of carrier members to line up. Accordingly, for the purpose of preventing the surfaces of each line of carrier members from being irregular, a high manufacturing accuracy of the carrier members is required. It is also required to use such material for the carrier members so that deformation with the passage of time and abrasion caused by the repeated movement of the carrier members may be decreased. As a result, the manufacturing cost of the carrier members significantly increases. In particular, the above problem often appears when the carrier members are moved at high speed.

Further, the other weaving apparatus employing the torsion lace method is disclosed in British patent No. 1,356,524.

In the weaving apparatus, track members having a plurality of guide grooves along the longitudinal direction thereof are provided in parallel along the width direction thereof, and carrier members supporting one end of wires are contained into the guide grooves respectively. The movement of carrier members in the row direction is performed by moving the track members in the longitudinal direction thereof, while the movement of carrier members in the column direction is performed by sliding the carrier members to the adjacent track members along the guide grooves.

According to the weaving apparatus, smooth movement of the carrier members can be accomplished in the column direction owing to a guide function of the guide grooves. However, the smooth movement of carrier members in the row direction is prevented when the number of the carrier members increases. It is difficult to manufacture such a carrier member because the width thereof is entirely equal to the width of the track member. In such a case where the number of the carrier members arranged in the column direction increases, when the carrier members are moved in the column direction, some of carrier members are moved so that they are positioned between the track members adjoining each other. Thus, that these carrier members prevent the next movement of carrier members in the row direction.

A weaving method is disclosed in U.S. Pat. No. 4,621,560 which allows the carrier members to be moved smoothly in both row and column directions, while using track members which have the same constructions as that of the above track members in British patent No. 1,356,524.

According to the above weaving method, although the movement of carrier members in the column direction is performed by causing all of the carrier members to move along the guide grooves simultaneously, the movement of carrier members in the row direction is sequentially performed. The area having all of the carrier members moving in the row direction is segmented into a plurality of blocks. Namely, first the n-th row of track member is moved in the longitudinal direction (i.e. the row direction) thereof, so that the carrier members contained in the first to n-th rows of track members are lined up in row direction respectively, and then the first to n-th rows of track members are moved along the longitudinal direction thereof to move the first to n-th rows of carrier members in the row direction respectively. Next, the 2n-th row of carrier members is moved along the longitudinal direction (i.e. the row direction) thereof, so that the carrier members contained in the (n+1)-th to 2n-th rows of track members are lined up along row direction respectively, and then the (n+1)-th to 2n-th rows of track members are moved along the longitudinal direction thereof to move the (n+1)-th to 2n-th rows of carrier members along row direction respectively. Similarly, the (2n+1)-th to 3n-th rows of carrier members, the (3n+1)-th to 4n-th rows of carrier members, . . . are sequentially moved along the row direction, thus the movement in the row direction of all rows of carrier members is completed. Therefore, the weaving method makes necessary a great amount of weaving since the movement of carrier members in the row direction is sequentially performed by each segmented block.

SUMMARY OF THE INVENTION

The present invention is directed to a method of and an apparatus for weaving a three-dimensional article from a plurality of fibers.

The first aspect of the inventive method of weaving a three-dimensional article from a plurality of fibers with weaving means having a plurality of carrier members comprises: (a) a step of arranging the carrier members in the form of a matrix, and setting a plurality of rectangular blocks by segmenting an area and arranging the carrier members along a column direction and a row direction of the matrix: and (b) a step of choosing prescribed blocks within said rectangular blocks to cause the carrier members of the prescribed blocks to hold the fibers, and performing sequentially and alternately a basic weaving operation every prescribed block. The basic weaving operation comprises (b-1) a first step of moving the carrier members arranged at even rows and the carrier members arranged at odd rows along the row direction by a prescribed amount, (b-2) a second step of moving the carrier members arranged at even columns and the carrier members arranged at odd columns along the column direction by a prescribed amount, (b-3) a third step moving the carrier members arranged at the even rows and the carrier members arranged at the odd rows in the opposite direction to that in the first step by a prescribed amount, and (b-4) a fourth step of moving the carrier members arranged at the even columns and the carrier members arranged at the odd columns in the opposite direction to that in the second step by a prescribed amount.

The second aspect of the inventive method of weaving a three-dimensional article from a plurality of fibers with weaving means having a plurality of carrier members comprises (a) a step of arranging the carrier members in the form of a matrix, and performing a basic weaving operation with respect to a whole area of the carrier members holding the fibers; and (b) a step of setting a plurality of rectangular blocks by segmenting the whole area of the carrier members holding the fibers along the column direction and the row direction, and performing the basic weaving operation with respect to at least one block. The basic weaving operation comprises (a-1) a first step of moving the carrier members arranged at even rows and the carrier members arranged at odd rows along a row direction of the matrix by a prescribed amount, (a-2) a second step of moving the carrier members arranged at even columns and the carrier members arranged at odd columns along a column direction of the matrix by a prescribed amount, (a-3) a third step of moving the carrier members arranged at the even rows and the carrier members arranged at the odd rows in the opposite direction to that in the first step by a prescribed amount, and (a-4) a fourth step of moving the carrier members arranged at the even columns and the carrier members arranged at the odd columns in the opposite direction to that in the second step by a prescribed amount.

The inventive apparatus for weaving a three-dimensional article from a plurality of fibers comprises: (a) weaving means having a plurality of carrier members arranged in the form of a matrix, and interweaving the fibers by alternately moving the carrier members along a column direction and a row direction of the matrix; (b) first guide means capable of inserting in and extracting from between the carrier members adjoining each other along the row direction; (c) second guide means capable of inserting in and extracting from between the carrier members adjoining each other along the column direction; and (d) control means controlling the weaving means, the first guide means and the second guide means. The control means comprises (d-1) first control means which inserts the first guide means in between the carrier members, while extracting the second guide means from between the carrier members, (d-2) second control means which moves the carrier members arranged at even rows and the carrier members arranged at odd rows along the row direction by a prescribed amount, after completing a control operation of the first control means, (d-3) third control means which inserts the second guide means in between the carrier members, while extracting the first guide means from between the carrier members, after completing a control operation of the second control means, (d-4) fourth control means moving the carrier members arranged at even columns and the carrier members arranged at odd column along the column direction by a prescribed amount, after completing a control operation of the third control means, (d-5) fifth control means inserting the first guide means in between the carrier members, while extracting the second guide means from between the carrier members, after completing a control operation of the fourth control means, (d-6) sixth control means moving the carrier members arranged at the even rows and the carrier members arranged at the odd rows in the opposite direction to that in the second control means by a prescribed amount, after completing a control operation of the fifth control means, (d-7) seventh control means inserting the second guide means in between the carrier members, while extracting said first guide means from between the carrier members, after completing a control operation of the sixth control means, and (d-8) eighth control means moving the carrier members arranged at the even columns and the carrier members arranged at the odd columns in the opposite direction to that in the fourth control means by a prescribed amount, after completing a control operation of the seventh control means.

Accordingly, a principal object of the present invention is to provide a method of weaving a three-dimensional article which can weave many kinds of three-dimensional articles having different sectional forms by using a low-cost weaving apparatus, while not changing the layout of carrier member drivers and the like.

The other object of the present invention is to provide a method of weaving a three-dimensional article with a varied weaving density.

The other object of the present invention is to provide an apparatus for weaving a three-dimensional article which can smoothly move carrier members in two directions making a right angle with each other, and weave rapidly the three-dimensional article even if the number of the carrier members increases.

According to the first aspect of the inventive method, the area arranging the carrier members in the form of the matrix is segmented into a plurality of rectangular blocks to choose the prescribed blocks therefrom for causing the carrier members of the prescribed blocks to hold the fibers, and then the basic weaving operation is sequentially and alternately performed by every prescribed block, so that the sectional form of the three-dimensional article thus woven corresponds with that of an aggregation of the prescribed blocks. Therefore, many kinds of three-dimensional articles having different sectional forms can be easily woven suitably choosing the prescribed blocks.

According to the second aspect of the inventive method, the basic weaving operation is performed with respect to the whole area of the carrier members holding the fibers, while the whole area of the carrier members holding the fibers is segmented into a plurality of rectangular blocks along the column direction and the row direction and then the basic weaving operation is performed with respect to one or more chosen rectangular blocks. The number of basic weaving operations for the chosen block is different from that of a non-chosen block. Thus it is possible to weave a three-dimensional article having a varied weaving density.

According to the inventive apparatus, the first guide means for guiding the movement in the row direction of the carrier members and the second guide means for guiding the movement in the column direction of the carrier members are provided, and therefore even if the number of carrier members increases, weaving operation is smoothly carried out since the movement of carrier members in the row and the column directions are guided by the first and the second guide means respectively.

The three-dimensional article thus woven can be used the reinforce fiber articles for composite material such as FRP, FRM, C/C composites and the like, functional material such as a filter, heat insulating material, soundproof material, vibration absorbing material, gland packing and the like, a band, clothes and so on.

As species of fibers, there are inorganic fiber such as metallic fiber, carbon fiber, alumina fiber and the like, organic fiber of many species, and hybrid fiber comprising inorganic fiber and organic fiber, and these species are elected corresponding to a use.

These and other objects, features, aspects and advantages of the present invention will become more apparent from the following detailed description of the present invention when taken in conjunction with the accompanying drawings.

DESCRIPTION OF THE PREFERRED EMBODIMENTS

A. Basic Principle in Weaving Method of Three-Dimensional Article

A basic principal as for a method of weaving an ordinary three-dimensional article will be described below. FIGS. 1A to 1D are front views, wherein a plurality of carrier members 1 having bobbins, for example, are arranged in the form of a matrix within a plane. In order to make a explanation more simple, these views show a case where the carrier members are arranged in four rows (A, B, C, D) and four columns (P, Q, R, S). Fibers (not shown) are withdrawn from the bobbins of the carrier members toward the front of the paper in which FIGS. 1A to 1d are drawn, and one side of the fibers thus withdrawn are bundled to fix to one place. In the above state, a basic weaving operation comprising the following four steps is performed with respect to all of the carrier members 1 as shown in FIGS. 1A to 1D.

Figure 1A:
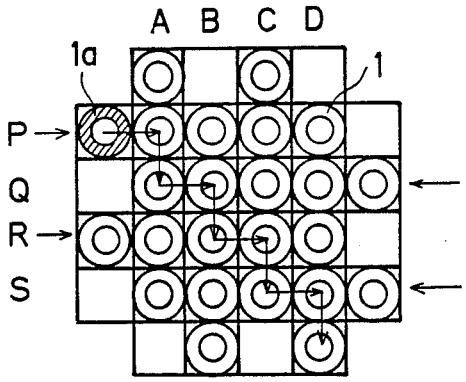
FIGS. 1A to 1D are views for explaining a basic principle as for a method of weaving a three-dimensional article.

(a) First step: The carrier members 1 arranged at odd columns (P, R) and the carrier members 1 arranged at even columns (Q, S) are moved along a column direction by a prescribed amount as shown in FIG. 1A. In this case, the movement amount of each carrier member 1 is integral times the length of one carrier member 1. FIGS. 1A to 1D show a case where the movement amount of each carrier member 1 is the same as the length of one carrier member 1.

Figure 1B:
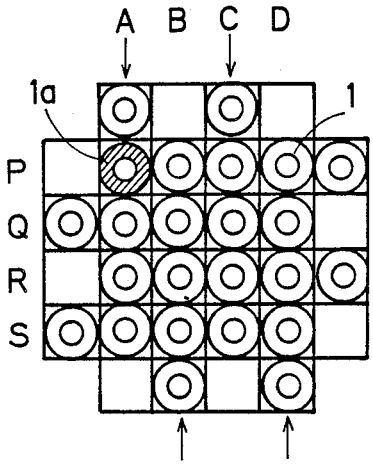

(b) Second step: The carrier members 1 arranged at odd rows (A, C) and the carrier members 1 arranged at even rows (B, D) are moved along a row direction by a prescribed amount as shown in FIG. 1B.

Figure 1C:
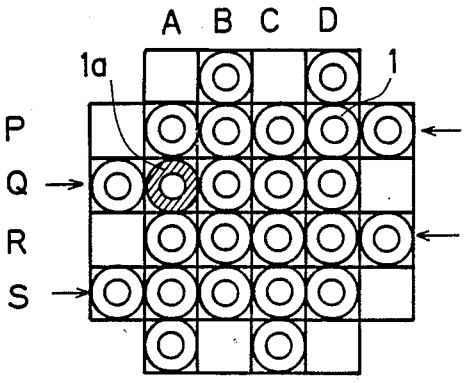

(c) Third step: The carrier members 1 arranged at the odd columns (P, R) and the carrier members 1 arranged at the even columns (Q, S) are moved in the opposite direction to that in the first step by a prescribed amount as shown in FIG. 1C.

Figure 1D:
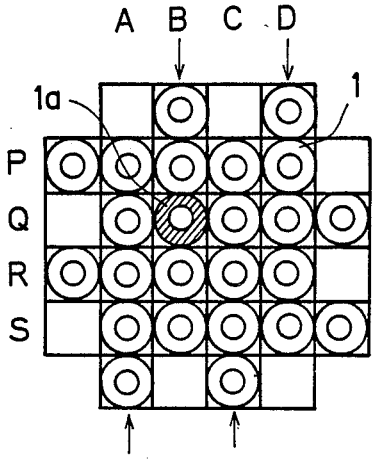

(d) Fourth step: The carrier members 1 arranged at the odd rows (A, C) and the carrier members 1 arranged at the even rows (B, D) are moved in the opposite direction to that in the second step by a prescribed amount as shown in FIG. 1D.

Figure 2:
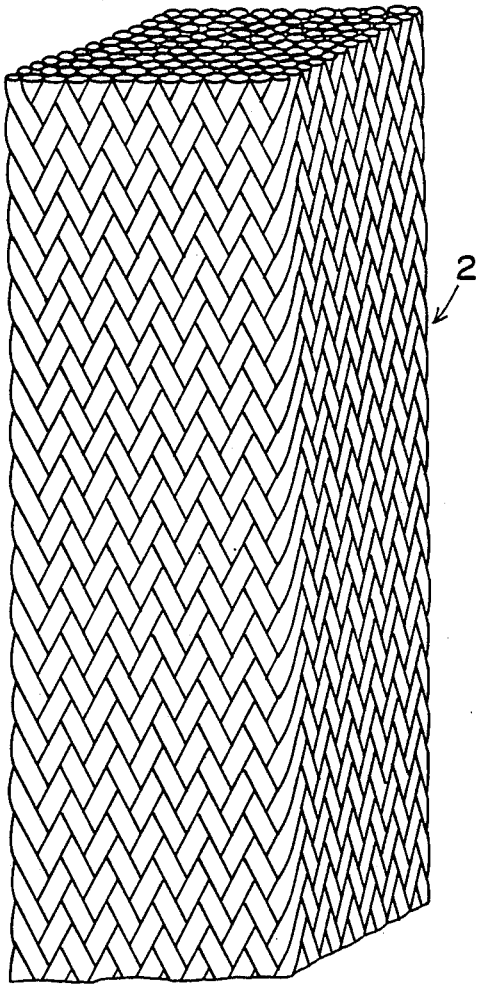
FIG. 2 is a perspective view of a three-dimensional article.

Looking at one carrier member 1 shown by oblique lines in FIGS. 1A to 1D, this carrier member 1 travels in the order of (A, P), (A, Q) and (B, Q) by the first basic weaving operation, and then by repeating the basic weaving operation, the carrier member 1 is traveled along the zigzag line shown by arrows in FIG. 1A. Similarly, the carrier members 1 arranged at the other positions travel along original zigzag lines by repeating the basic weaving operation, respectively. Thus, by repeating the basic weaving operation, the fibers are intertwined with each other, whereby a three-dimensional article 2 as shown in FIG. 2, for example, are woven.

B. First Embodiment

Figure 3:
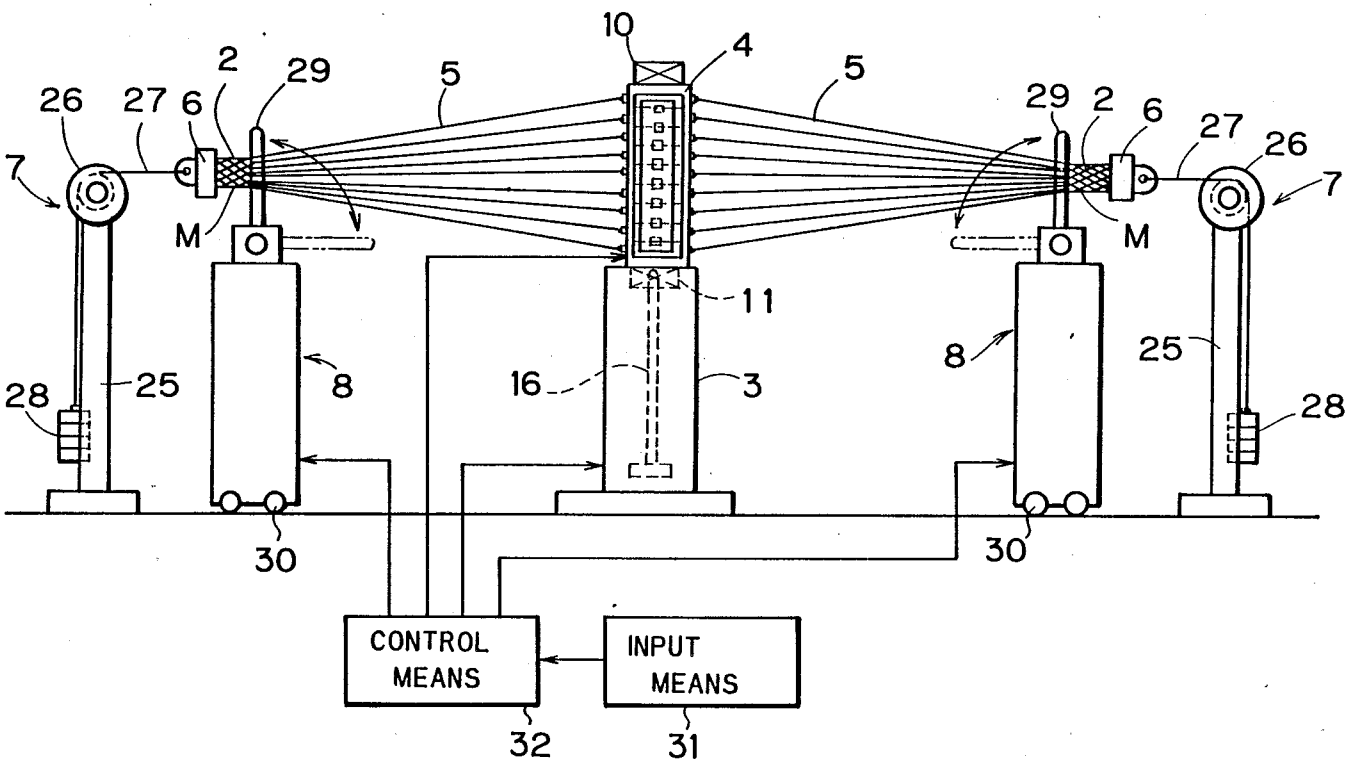
FIG. 3 is a side view showing the first embodiment of an apparatus for weaving a three-dimensional article according to the present invention.

FIG. 3 is a side view showing the first embodiment of an apparatus for weaving a three-dimensional article according to the present invention.

Weaving means 4 supported by a frame 3 is provided on a central part of this apparatus as shown in FIG. 3. A pair of fiber supporting means 6 for supporting and bundling one end of fibers 5 and a pair of takeup means 7 for applying prescribed tensions to the fibers 5 through the supporting means 6 are provided on the both sides of the weaving means 4, respectively. A pair of reed means 8 are provided between the weaving means 4 and the fiber supporting means 6 to tighten woven fabrics of three-dimensional articles 2 woven by the weaving means 4.

Figure 4:
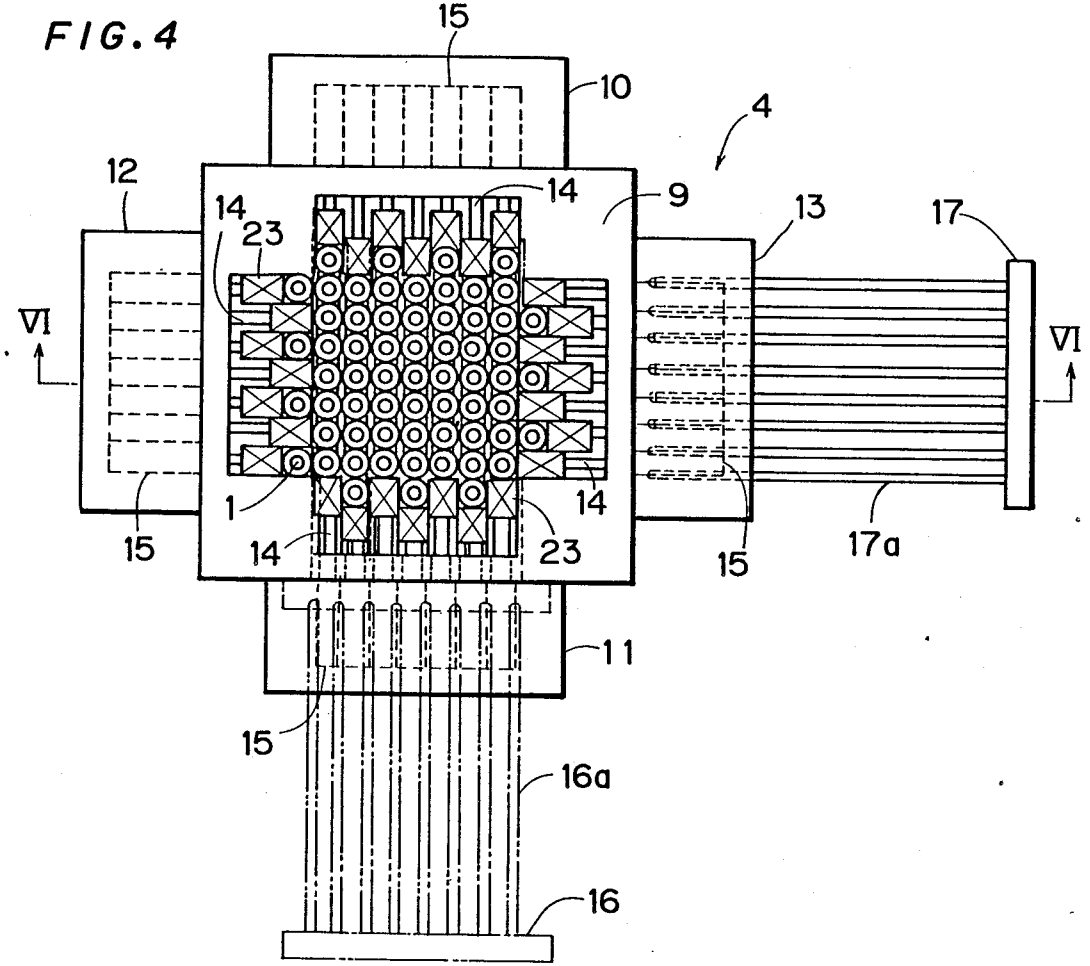
FIG. 4 is a front view of weaving means.
Figure 5:
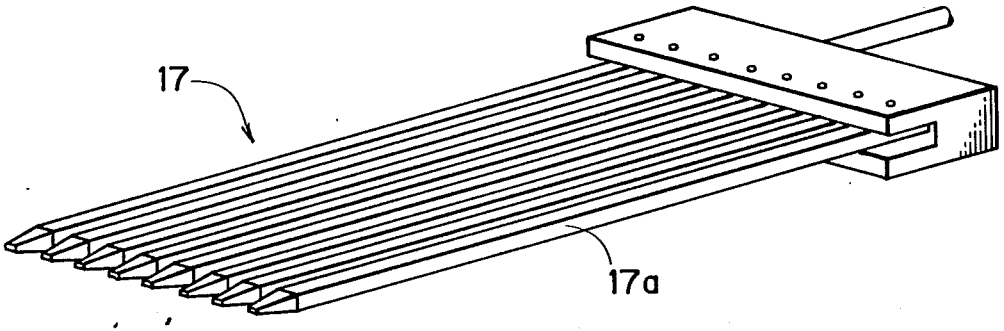
FIG. 5 is a perspective view of a guide means.
Figure 6:
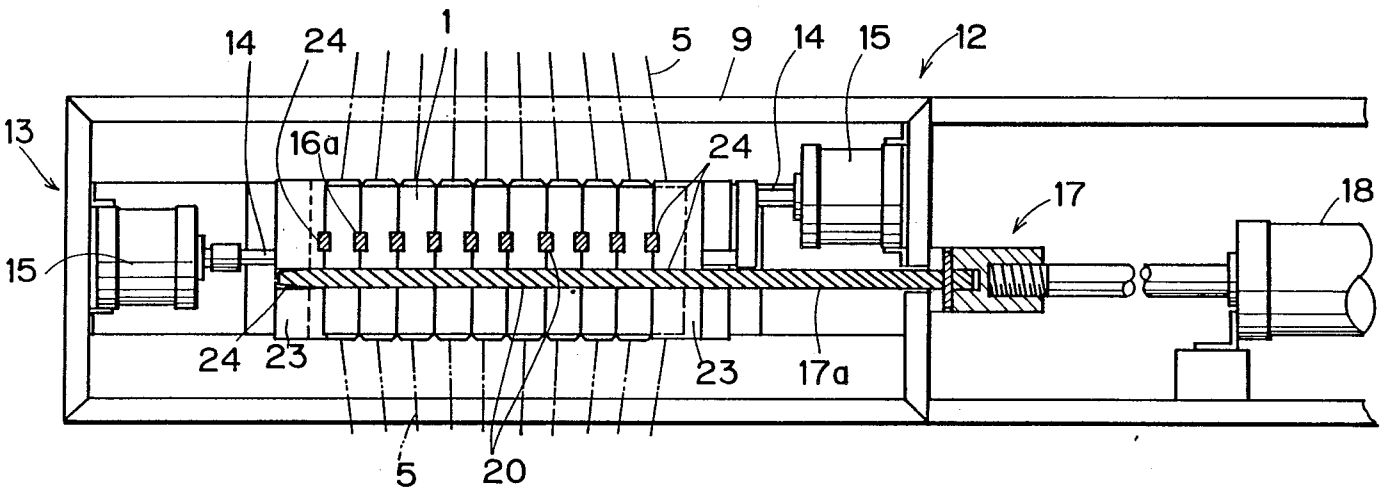
FIG. 6 is a sectional view taken along the line VI—VI in FIG. 4.

FIG. 4 is a front view of the weaving means 4 seen from a longitudinal direction of the fiber 5. In this weaving means 4, a plurality of carrier members 1 are arranged in the form of a matrix within a housing 9, and carrier member drivers 10 and 11 for causing the carrier members 1 to move in a row direction (i.e. a vertical direction) and carrier member drivers 12 and 13 for causing the carrier members 1 to move in a column direction (i.e. a horizontal direction) are provided on the circumference of the housing 9, respectively. The carrier member drivers 10 to 13 comprise rods 14 for pushing each column or row of carrier members 1 and drive means 15, such as cylinders, solenoids and the like, for driving the rods 14 each column or row. A first guide means 16 is provided on the lower side of housing 9 to guide the movement of the carrier members 1 in the row direction, while a second guide means 17 is provided on the right side of the housing 9 to guide the movement of the carrier members 1 in the column direction as shown in FIG. 4. FIG. 5 is a perspective view of the guide means 17. FIG. 6 is a sectional view taken along the line VI—VI in FIG. 4, wherein both of guide means 16 and 17 are inserted in the housing 9. As shown in FIGS. 5 and 6, the guide means 17 have a plurality of guide-rods 17*a* arranged in parallel with each other, and the guide means 17 is driven by drive means 18 such as an air cylinder and the like so that each guide-rod 17*a* can be inserted in and extracted from between the carrier members 1 adjoining each other along the column direction. Similarly, the guide means 16 shown in FIG. 4 have a plurality of guide rods 16*a* arranged in parallel with each other, and the guide means 16 is driven by drive means (not shown) so that each guide-rod 16*a* can be inserted in and extracted from between the carrier members 1 adjoining each other along the row direction. The lengths of the guide-rods 16*a* and 17*a* are larger than the total length of a row or column of carrier members. The numbers of the guide-rods 16*a* and 17*a* are equal to that capable of inserting in among all lines of carrier members 1. The guide means 16 may be arranged on an upper and a lower positions of the housing 9 to insert the guide-rods 16*a* to a central position of each row of carrier members 1 from the upper and the lower positions of the housing 9. Similarly, the guide means 17 may be arranged on a right and left positions of the housing 9 to insert the guide-rods 17*a* to a central position of each column of carrier members 1 form the right and the left positions of the housing 9.

Figure 7:
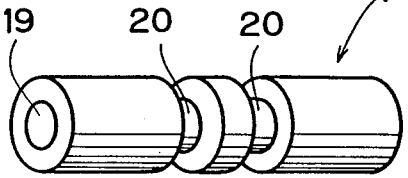
FIG. 7 is a perspective view of a carrier member.
Figure 8:
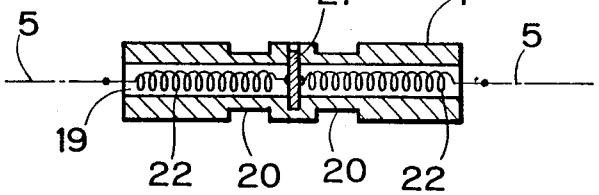
FIG. 8 is a sectional view of a carrier member.

FIG. 7 is a perspective view of the carrier member 1, and FIG. 8 is a sectional view of the carrier members 1. As shown in FIGS. 7 and 8, the carrier member has a barrel-like shaped body, having a through hole 19 in the center thereof, whose cross section is a circle, and two depressions 20 capable of passing through the guide-rods 16*a* and 17*a* of the guide means 16 and 17 are respectively provided on a circumferential surface of the body along a longitudinal direction. A pin 21 is fixed to the center part of the through hole 19, while a pair of spring means 22 are provided on both sides of the pin 21 in the through hole 19. One end of the spring means 22 is fixed to the pin 21, while the other end of the spring means 22 is connected to one end of the fibers 5. Namely, the carrier member 1 holds the fibers 5.

The holding means is not restricted to this, any means capable of supporting the fiber 5 by the carrier member 1, for example, such means as a through hole is formed at the carrier member 1 to pass through the fiber 5 therein, may be employed.

Figure 9:
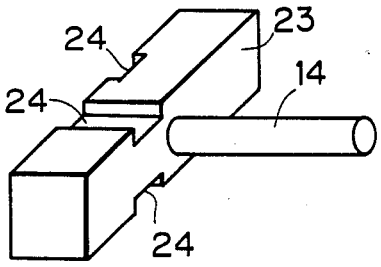
FIG. 9 is a perspective view of a dummy carrier member.

As shown in FIG. 9, a dummy carrier member 23 is fixed to the tip of the rod 14 for pushing a line of carrier members 1, and the length of the dummy carrier member 23 is equal to that of the carrier member 1 so as to be able to push the carrier member 1 over the full length thereof. The cross section of the dummy carrier member 23 is formed to a square, and two depressions 24 capable of passing through the guide rods 16*a* and 17*a* of the guide means 16 and 17 are respectively provided on the circumferential surface of the dummy carrier member 23.

Figure 10:
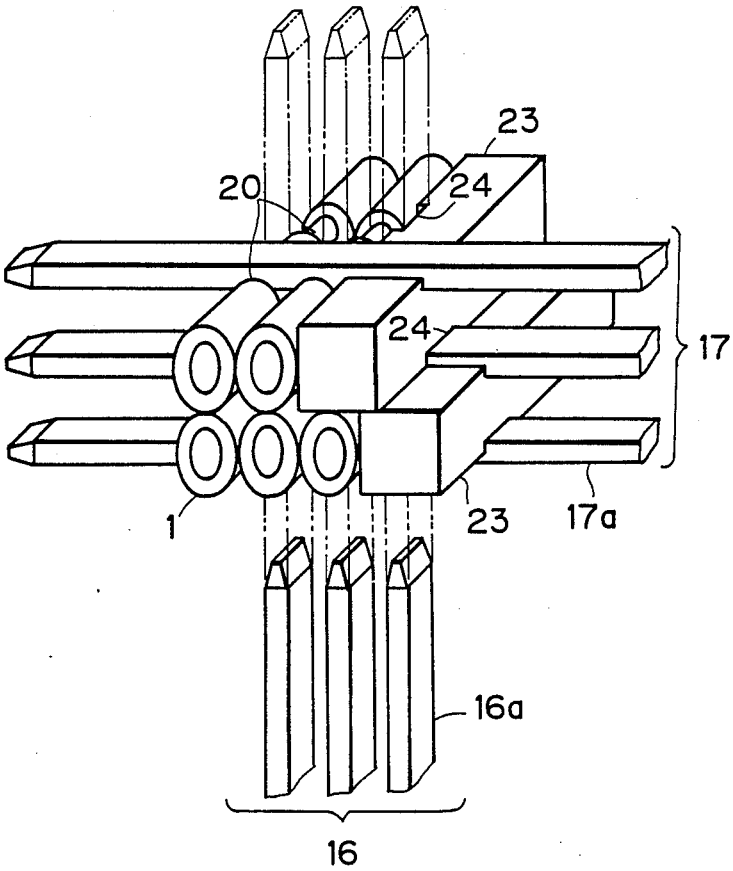
FIG. 10 is a perspective view showing the inserting state of guide means.

FIG. 10 is a perspective view showing the inserting state of the guide means 16 and 17, wherein for the sake of moving the carrier members 1 along the column direction, the guide-rods 17*a* of the guide means 17 are leftward moved so as to be inserted in the depressions 24 of the dummy carrier members 23 and the depressions 20 of the carrier members 1, while the guide-rods 16*a* of the guide means 16 are downward extracted from the positions shown by chain lines in FIG. 10. In the state, the movement of each column of carrier members 1 along the column direction is guided by the guide-rods 17*a* arranged at the both sides thereof. Similarly, when the carrier members 1 are moved along the row direction, the guide-rods 16*a* are inserted in the positions shown by the chain lines in FIG. 10, while the guide-rods 17*a* are rightward extracted, thus the movement of each row of carrier members 1 along the row direction is guided by the guide-rods 16*a* arranged at the both sides thereof.

Therefore, it is desirable that the thicknesses of the guide-rods 16*a* and 17*a* are equal to or slightly larger than the width of the space formed by the depressions 20 of the carrier members 1 adjoining each other as a pathway of the guide-rod 16*a* or the guide-rod 17*a*. In the case, each row or column of carrier members 1 moves on the guide-rods 16*a* or the guide rods 17*a*, but not on the surfaces of the adjacent row or column of carrier members 1.

Figure 11:
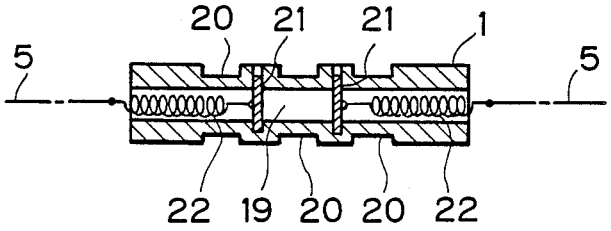
FIG. 11 is a sectional view of another carrier member.
Figure 12:
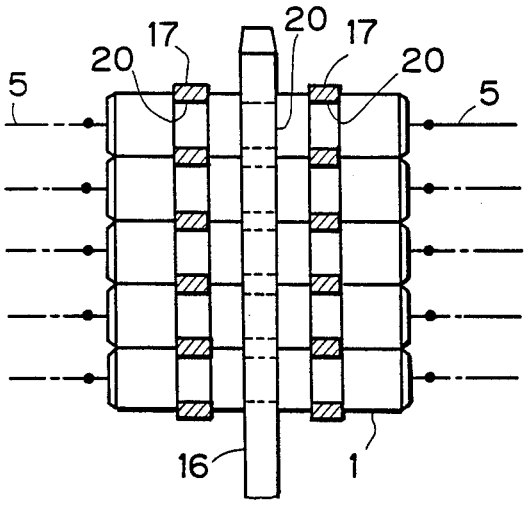
FIG. 12 is a schematic sectional view showing the inserting state of guide means.
Figure 13:
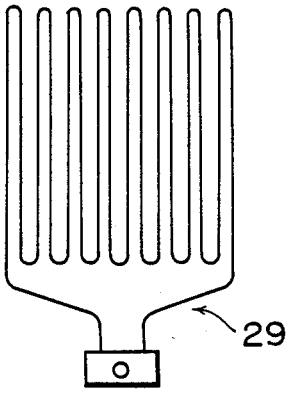
FIGS. 13 to 15 are front views of reed bodies respectively.

Further, a carrier member 1 may be employed having three depressions 20 along a longitudinal direction on the circumferential surface thereof as shown in FIG. 11. In that case, as shown in FIG. 12, one guide means 16 for guiding the movements of the carrier members 1 in the row direction may be inserted in the depressions 20 arranged at the center parts of the carrier members 1, while a pair of guide means 17 for guiding the movements of carrier members 1 in the column direction may be inserted in the depressions 20 arranged at the both ends of the carrier members 1 respectively. As a result, the both ends of carrier members 1 can be supported in a well-balanced state by a pair of guide means 17.

Referring to FIG. 3, the other end of the fibers 5, whose one end is supported by the carrier members 1 as stated above, is supported by the fiber supporting means 6 to be bundled at one part.

In each the takeup means 7, a pulley 26 is rotatably fixed on the top of a base 25, and one end of a wire rope 27 hanged on the pulley 26 is connected with the fiber supporting means 6 while the other end of the wire rope 27 is connected with a weight 28. Therefore, the tension of the fibers 5 is determined by the weight 28, and invariable tension is always applied to the fiber 5 whenever a weaving operation proceeds.

Each reed means 8 has a reed body 29 for hitting an interwoven part M of a three-dimensional article 2. The reed body 29 is rotatably driven within a vertical plane along the axis of the fiber 5 by a driver, such as a motor, which is provided in the reed means 8. The reed means 8 also has wheels 30 so that the reed means 8 can be moved.

Figure 14:
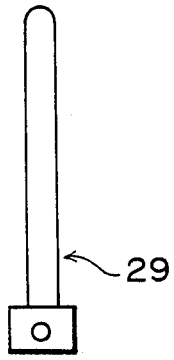
Figure 16:
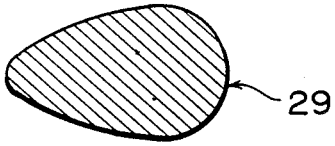
FIGS. 16 and 17 are sectional views of reed bodies respectively.
Figure 15:
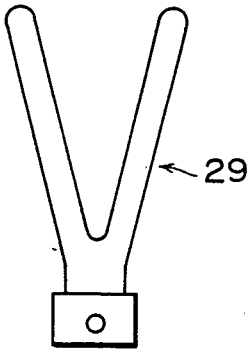
Figure 17:
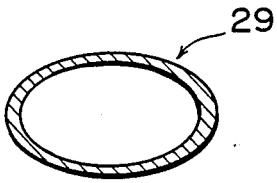

A material having a low friction coefficient, such as tetrafluorethylene resin, is coated on the surface of the reed body 29. The reed body 29 may have a comb-like shape with a plurality of rod-shaped members being arranged in parallel corresponding to the number of rows or columns, but it is preferable to employ a comb-like shape having rod-shaped members whose number is less than one-third to one-fifth the number of rows and columns. In a case of weaving the three-dimensional article 2 having a simple sectional form as the above embodiment, a reed body 29 as shown in FIGS. 14 or 15 can be employed, wherein the reed body 29 has only one rod-shaped member or two rod-shaped members formed to a V-shape. The rod-shaped member may by formed by a pipe whose diameter is five to twenty millimeters. The sectional form of the rod-shaped member may be circular, but it is preferable to employ a triangular or an elliptical shape, as shown in FIGS. 16 or 17, so that the rod-shaped member can be easily penetrated among the fibers 5 toward the interwoven part M of the three-dimensional article 2. It is preferable to employ a rotary motion as the motion of the reed body 29, as shown in FIG. 3, so that the reed means 8 can be easily fabricated, but both linear motions of a vertical direction and a horizontal direction may be employed.

Referring to FIG. 3, the apparatus further comprising input means 31 for inputting information and many kinds of commands required for a weaving operation and control means 32 for controlling the weaving means 4, the guide means 16 and 17, and the reed means 8 on the basis of a program stored in memory means (not shown) in reply to the commands inputted by the input means 31.

Figure 18A:
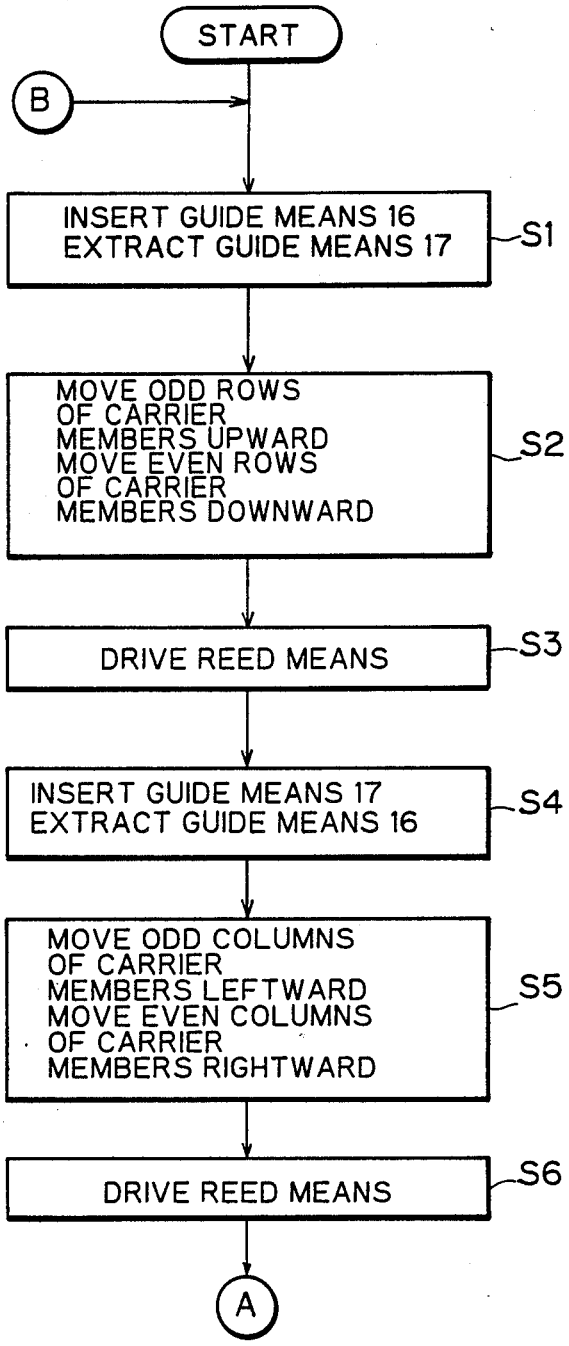
FIGS. 18A and 18B are flow charts showing the operation of the first embodiment, respectively.
Figure 18B:
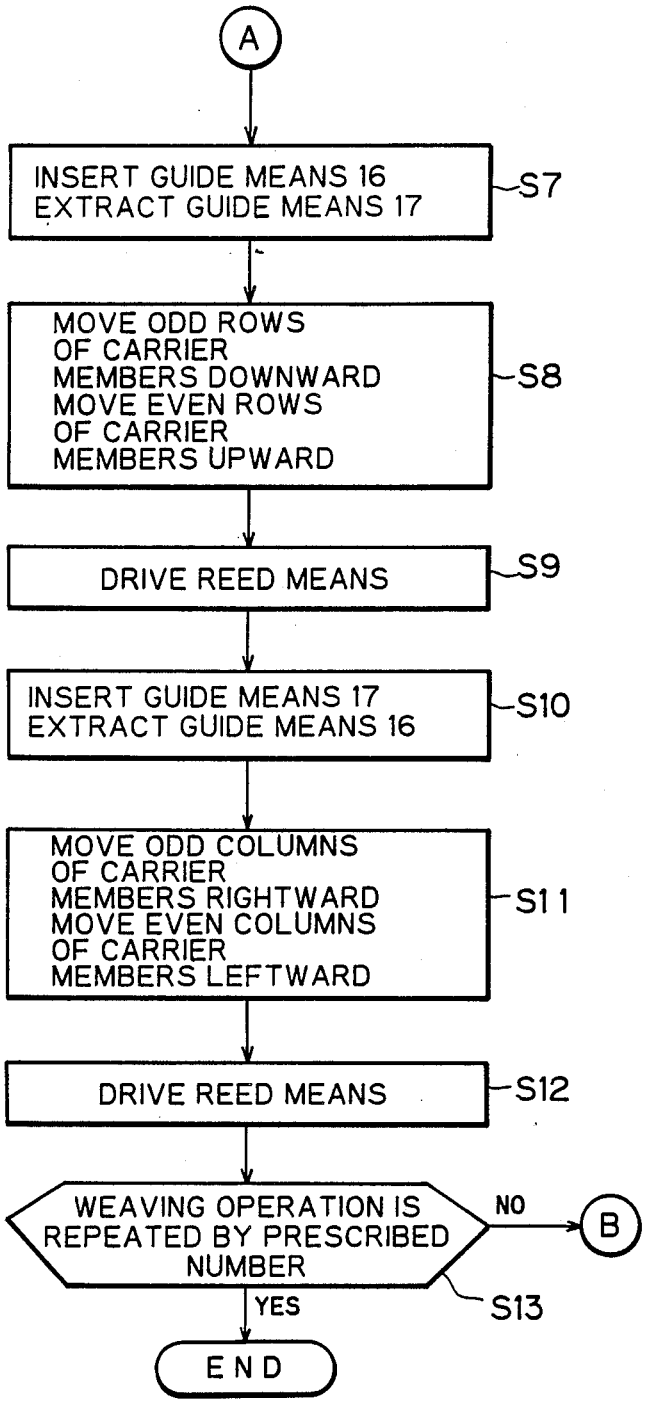

The weaving operation of the apparatus will be described below. The fibers 5 are stretched between the carrier members 1 and the fiber supporting means 6 on the both sides of the weaving means 4, while being applied tension by the takeup means 7. In the state, information such as the number of a weaving operation, for example, is inputted by the input means 31, and then a starting command is applied to the input means 31, so that the apparatus starts to drive on the basis of flow charts as shown in FIGS. 18A and 18B.

First, in a step S1, the guide means 16 is inserted in between the carrier members 1 along the row direction, and thereafter the guide means 17 is extracted from between the carrier members 1.

In a step S2, the carrier members 1 arranged at odd rows (C, E and G rows in FIG. 19) are moved upward by one stroke, while the carrier members 1 arranged at even rows (B, D, F and H rows in FIG. 19) are moved downward by one stroke. Where, above one stroke corresponds to the length which is integral times the length of one carrier member 1. The movements of the carrier members 1 in the row direction are carried out by driving the rods 14 through the drive means 15 of the carrier member drivers 10 and 11 shown in FIG. 4 so that the carrier members 1 are pushed through the dummy carrier members 23.

In a step S3, the interwoven parts M are hit by the reed bodies 29 of the reed means 29 to tighten the woven fabric.

In a step S4, the guide means 17 is inserted in between the carrier members 1 along the column direction, and thereafter the guide means 16 is extracted from between the carrier members 1.

In a step S5, the carrier members 1 arranged at odd columns ($\bar{c}$, $\bar{e}$ and $\bar{g}$ columns in FIG. 19) are moved leftward by one stroke, while the carrier members 1 arranged at even columns ($\bar{b}$, $\bar{d}$, $\bar{f}$ and $\bar{h}$ columns in FIG. 19) are moved to the right by one stroke. The movement of the carrier members 1 in the column direction are carried out by driving the rods 14 through the driver means 15 of the carrier member drivers 12 and 13 shown in FIG. 4 so that the carrier members 1 are pushed through the dummy carrier members 23.

In a step S6, the woven fabrics are tightened by the reed means 8 in the same manner as that of the step S3.

In a step S7, the guide means 16 is inserted in between the carrier members 1, and thereafter the guide means 17 is extracted from between the carrier members 1 in the same manner as that of the step S1.

In a step S8, the carrier members 1 arranged at odd rows (C, E and Grows in FIG. 19) are moved downward by one stroke, while the carrier members 1 arranged at even rows (B, D, F and H rows in FIG. 19) are moved upward by one stroke.

In a step S9, the woven fabrics are tightened by the reed means 8 in the same manner as that of the step S3, and in a step S10, the guide means 17 is inserted in between the carrier members 1 and thereafter the guide means 16 is extracted from between the carrier members 1 in the same manner as that of the step S4.

In a step S11, the carrier members 1 arranged at odd columns ($\bar{c}$, $\bar{e}$ and $\bar{g}$ columns in FIG. 19) are moved rightward by one stroke, while the carrier members 1 arranged at even columns ($\bar{b}$, $\bar{d}$, $\bar{f}$ and $\bar{h}$ columns in FIG. 19) are moved leftward by one stroke.

In a step S12, the woven fabrics are tightened by the reed means 8 in the same manner as that of the step S3.

In a step S13, it is judged whether the weaving operation defined by the steps S1 to S12 has been repeated by a prescribed number or not, and when the weaving operation does not reach the prescribed number, it is returned to the step S1 to repeat the weaving operation. Thus, the carrier members 1 are alternately and regularly moved in both directions of row and column to cause the fibers 5 to interweave with each other, whereby two three-dimensional articles 2 are simultaneously woven on both sides of the weaving means 4. During the weaving operation, since the interwoven parts M move toward the weaving means 4 as the weaving operation advances, the reed means 8 are controlled by the control means 32 so that the reed means 8 move corresponding to the interwoven parts M. Thus, in the step S13, when it is confirmed that the weaving operation has been repeated by the prescribed number, the weaving operation is completed.

Figure 19:
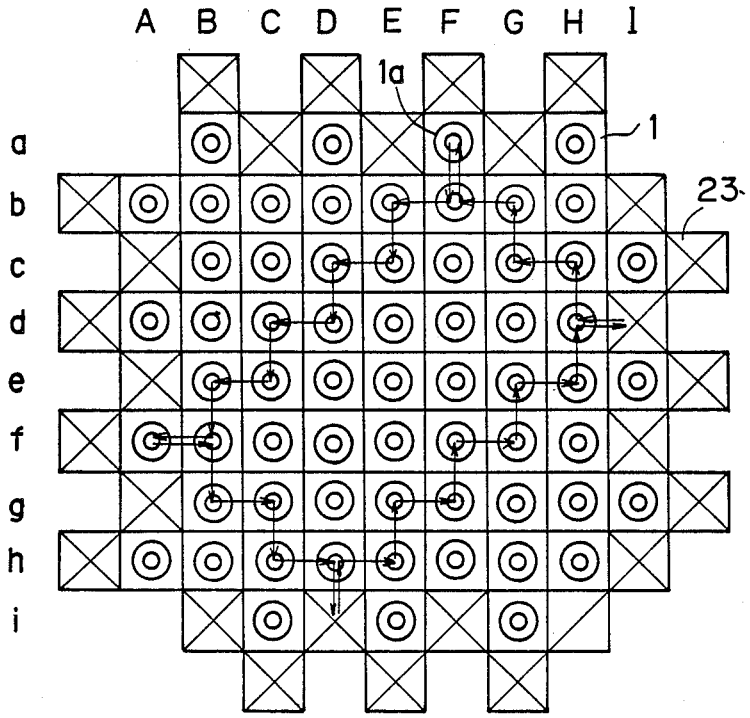
FIG. 19 is a view showing a movement locus of a specific carrier member.

For reference, a locus of a carrier member 1*a*, which is arranged at $\bar{a}$ column and F row at first and moved on the basis of the weaving operation, are shown by arrows in FIG. 19. In FIG. 19, the length of one stroke is equal to that of one carrier member 1.

The weaving apparatus has advantages described below, since the same has the guide means 16 and 17 capable of inserting in between the carrier members 1.

(a) Whenever the rows or columns of carrier members 1 are moved, each row or column of carrier members 1 is lined up by the guide means 16 or 17, and the movement of each row or column of carrier members 1 is accurately guided by the guide means 16 or 17, whereby the carrier members 1 can be smoothly moved along the column and row directions.

(b) The movements of all rows of carrier members 1 are simultaneously guided by the guide means 16 while the movements of all columns of carrier members 1 are simultaneously guided by the guide means 17, and therefore it is possible to rapidly-weave the three-dimensional article 2 even if the number of the carrier members 1 increases.

(c) Since the movement of each row or column of carrier members 1 is not guided by the surfaces of the adjacent row or column of carrier members 1, it is possible to use the carrier members 1 having low manufacturing accuracy and large coefficient of friction, whereby a manufacturing cost decreases.

According to the above embodiment, since one guide means is extracted from between the carrier members 1 after the other guide means is inserted in between the carrier members 1 in the steps S1, S4, S7 and S10 of FIG. 18, either of the above two guide means 16 and 17 is always in the state of being inserted among the carrier members 1, and therefore it is possible to prevent each carrier member 1 from being removed from the housing 9 by either of the above two guide means 16 and 17. In a case where there is no possibility that the carrier members 1 are removed from the housing 9, the insertion of one guide means and extraction of the other guide means may be simultaneously carried out, or one guide means may be inserted in between the carrier members 1 after the other guide means has been extracted from between the carrier members 1.

In the above embodiment, although the thickness of the guide means 16 and 17 is determined so that each row or column of carrier members 1 does not contact with the adjacent row or column of carrier members 1, in a case where the sectional form of each carrier member 1 is a circle as shown in FIG. 7, even if the thickness of the guide means 16 and 17 is determined so that each row or column of carrier members 1 contacts with the adjacent row or column of carrier members 1, frictional resistance between the carrier members 1 adjoining each other is small during the movement of the carrier members 1, and therefore the carrier members 1 can be smoothly moved. Moreover, in a case where the sectional form of each carrier member 1 is a circle, the manufacturing accuracy of the carrier member 1 improves.

Figure 21:
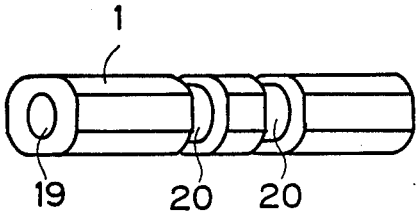
FIG. 21 is a perspective view of the other carrier member.
Figure 22:
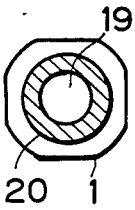
FIG. 22 is a sectional view of the carrier member in FIG. 21.
Figure 23:
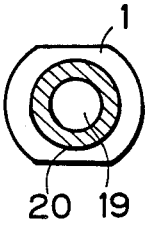
FIG. 23 is a sectional view showing a transformed example of the carrier member in FIG. 22.
Figure 20:
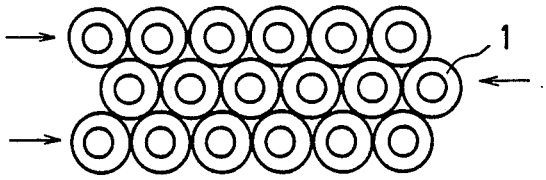
FIG. 20 is a view showing such a state as an arrangement of carrier members is broken.
Figure 24:
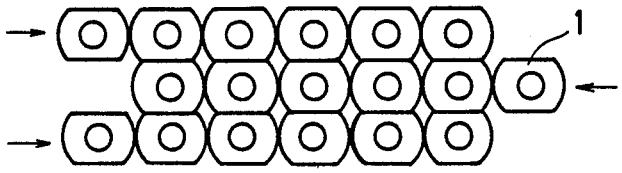
FIG. 24 is a view showing such a state as to prevent an arrangement of carrier members from being broken.

However, in a case where the sectional form of each carrier member 1 is a circle, when both of the guide means 16 and 17 are extracted from between the carrier members 1 on the basis of malfunction of the apparatus, there is the possibility that the layout of the carrier members 1 is loosened as shown in FIG. 20. To solve the above problem, the carrier members 1 having sectional forms as shown in FIGS. 21 to 23 can be employed. Namely, the carrier member 1 as shown in FIGS. 21 and 22 has such a sectional form as arcs sitting on upper, lower, right and left parts of a circle are cut, and the carrier member 1 as shown in FIGS. 23 has such a sectional form as arcs sitting on upper and lower parts of a circle are cut. If the carrier members 1 having such cutting parts are employed, even if both of the guide means 16 and 17 are extracted from between the carrier members 1 on the basis of malfunction of the apparatus, it is possible to prevent the layout of carrier members 1 from becoming loose as shown in FIG. 24.

In the wearing apparatus, the fibers 5 are connected with the carrier members 1 through the spring means 22 as shown in FIGS. 8 and 11. Each spring means 22 functions to apply moderate tension to the fiber 5 during the weaving operation. Namely, when the carrier member 1 moves toward a central part from a peripheral part of the housing 9 as the weaving operation advances, the path length between the weaving means 4 and the interwoven part M with respect to the fiber 5 connected with the carrier member 1 decreases. However, the change of the path length is absorbed by the spring means 22, so that a moderate tension is always applied to the fiber 5. Therefore, if the fibers 5 have elasticity, it is not always necessary to provide the spring means 22. In a case of omitting the spring means 22, each fiber 5 is passed through the through hole 9 of each carrier member 1.

According to the weaving apparatus, the woven fabric of the three-dimensional article 2 is tightened by the reed means 8, and therefore the volume fiber content of composite material increses, so that the strength of the composite material increses. To put it in the concretely, the tilt angle of the fiber 5 with respect to a horizontal imaginary line after weaving becomes twice or more because of the tightness of the woven fabric by the reed means 8. However, in a case where it is not necessary to strongly tighten the interwoven part M, or where it is not necessary to uniformly weave the interwoven part M, it is possible to decrease the number of reed operation by omitting the steps S3 and S9 in FIGS. 18A and 18B, for example, or it is possible to omit the reed means 8 according to circumstance.

Figure 25:
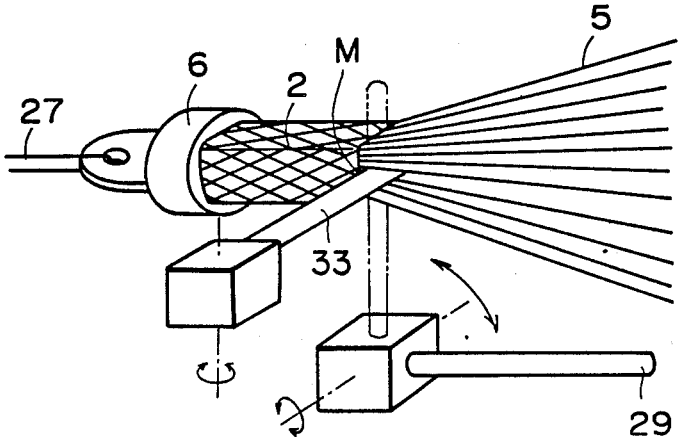
FIG. 25 is a perspective view showing a transformed example having two reed bodies.

The above weaving apparatus has only one reed body 29, however, in a case of weaving a three-dimensional article 2 whose size is large, in particular whose thickness is large, or a three-dimensional article 2 having a special sectional form such as a U-type, an I-type and the like, it is preferable to provide not only a reed body 29 rotatably driven in a vertical plane but also a reed body 33 rotatably driven in a horizontal plane as shown in FIG. 25. In that case, it is preferable to alternately carry out the reed operation of the reed bodies 29 and 33 at the rate of at least once to a basic weaving operation. Motors having reducers, air cylinders or hydraulic cylinders may be employed as drivers of the reed bodies 29 and 33.

Figure 26:
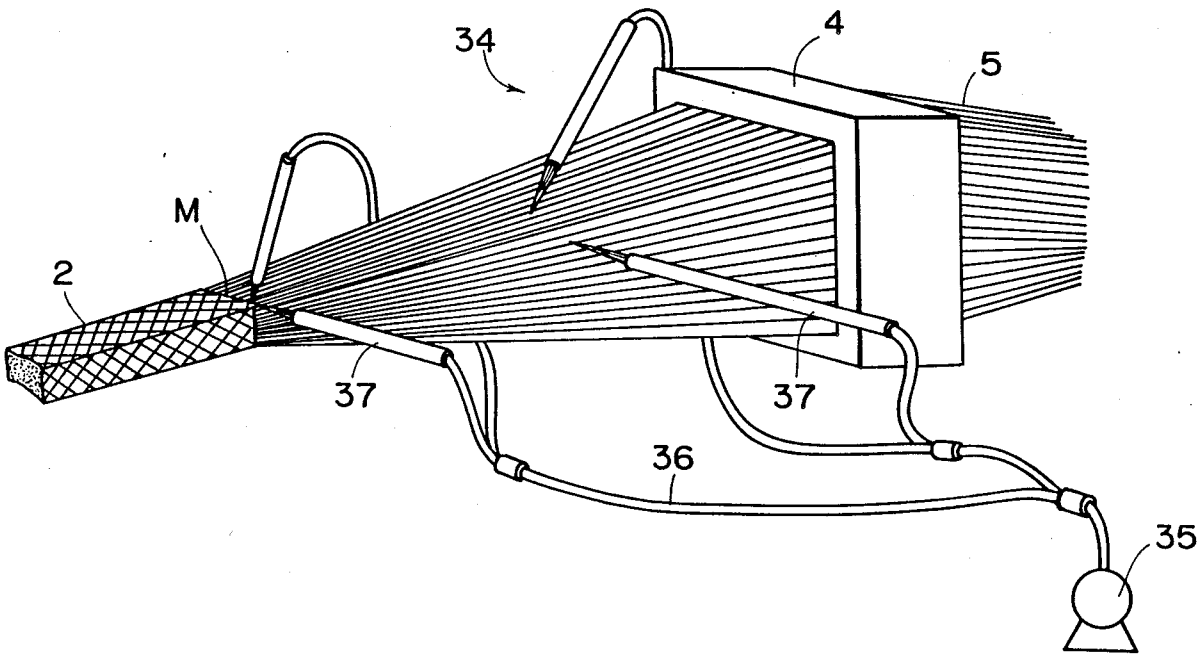
FIG. 26 is a perspective view showing a transformed example having a jet blower as reed means.

In a case of weaving low strength fibers such as hollow yarns for separate film, extra fine metallic fibers and the like, or high strength fibers arising furious fuzz by rubbing with a metallic reed body, it is preferable to employ reed means 34 made by a jet blower for blowing high pressure gas such as high pressure air and the like as shown in FIG. 26, instead of the above reed means 8. The reed means 34 functions to direct the air pressurized by a compressor 35 to the interwoven part M by nozzles 37 through hoses 36. For example, the pressure of the air is 2 to 5 kg/cm$^2$, while the diametors of the nozzles 37 are 1 to 3 mm, respectively. When the air of nozzles 37 is blown to the fibers 5 between the interwoven part M and the weaving means 4 in addition to the interwoven part M, it is also possible to prevent the fibers 5 from partially intertwisting each other. Instead of the above nozzle 37, a ring layout type perforation nozzle may be employed. According to the reed means 34 made by the jet blower, the rub between the air and the fiber 5 decreases in comparison with that between the metallic reed body and the fiber 5, whereby it is possible to guide the intertwining fibers 5 to each other by a comparatively small force.

C. Second Embodiment

Figure 28:
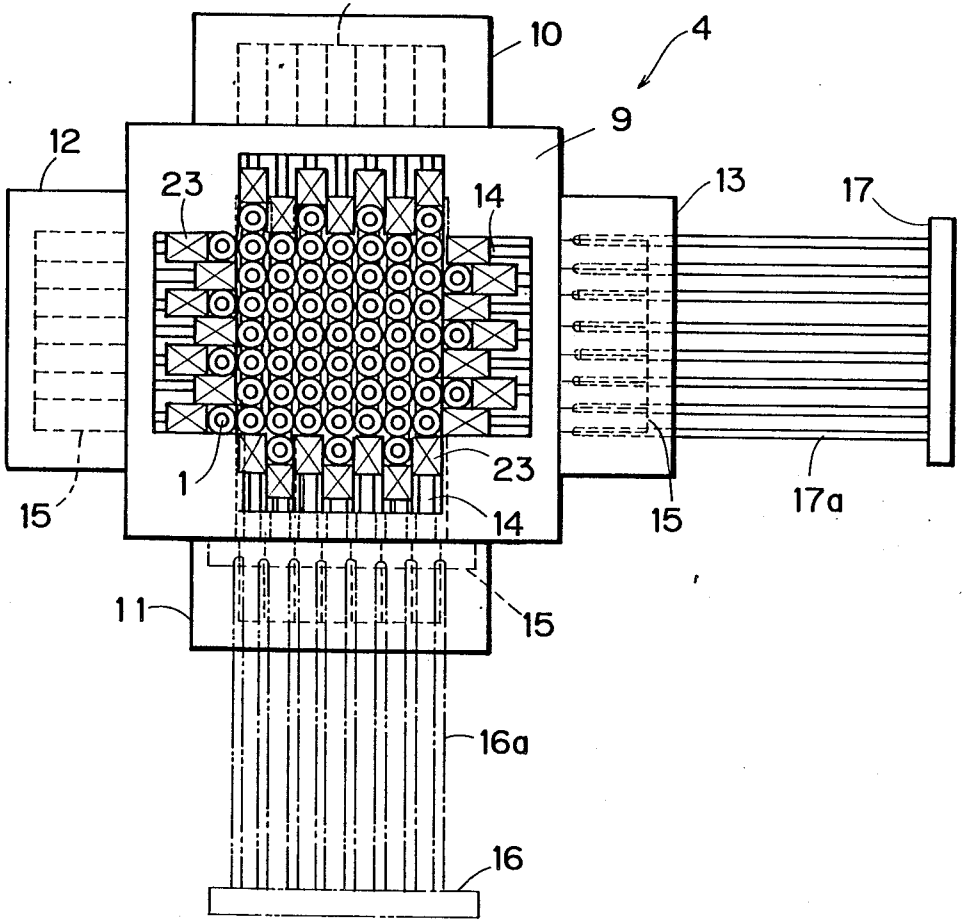
FIG. 28 is a front view of weaving means.
Figure 27:
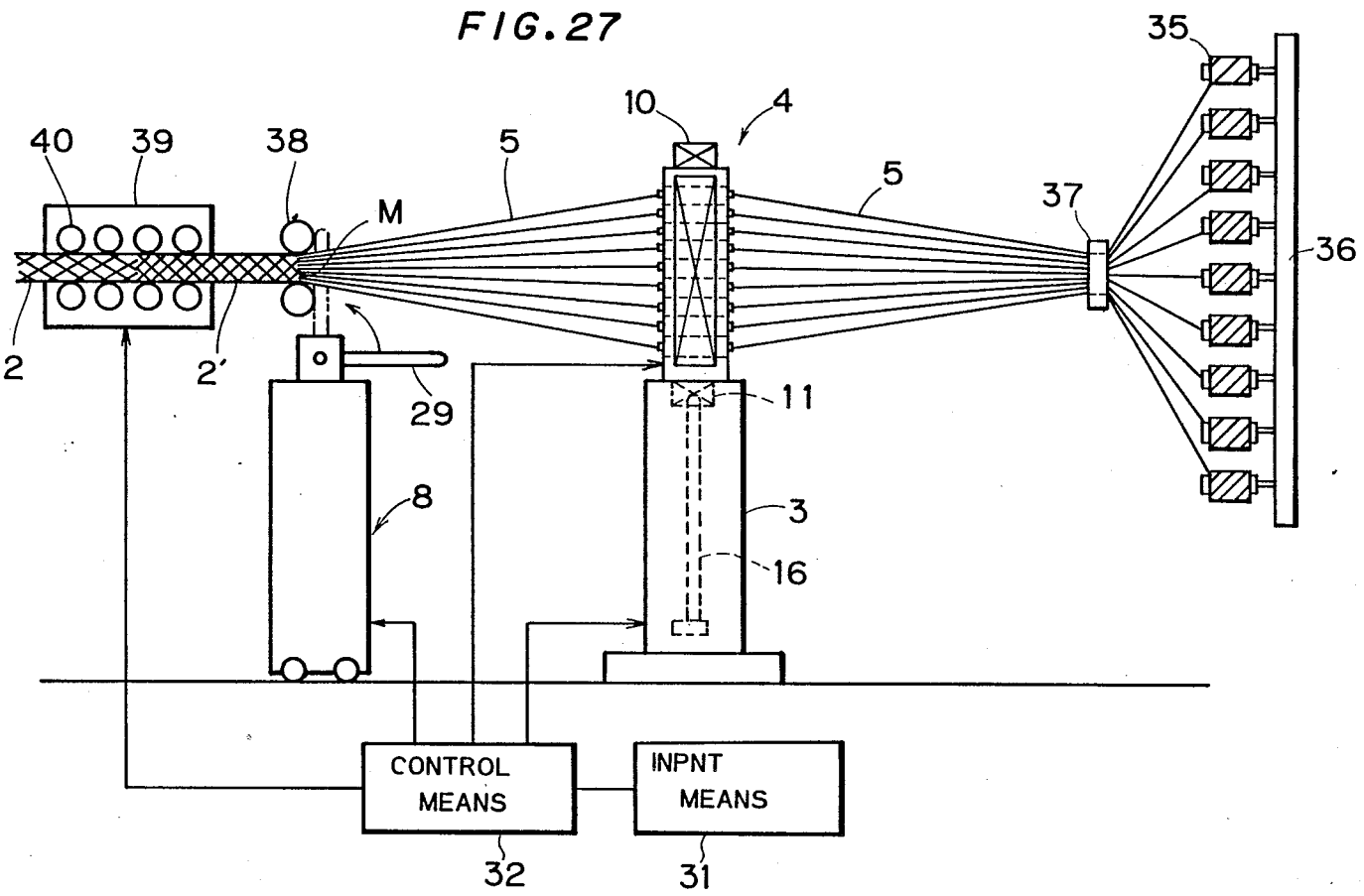
FIG. 27 is a side view showing the second embodiment of an apparatus for weaving a three-dimensional article according to the present invention.

FIG. 27 is a side view showing the second embodiment of an apparatus for weaving a three-dimensional article according to the present invention, and FIG. 28 is a front view of weaving means 4 in FIG. 27.

Figure 29:
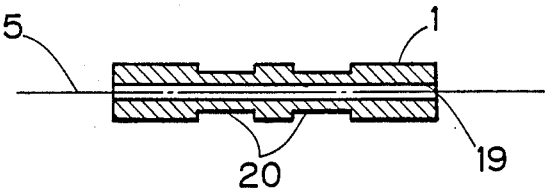
FIG. 29 is a sectional view of a carrier member which is used in the weaving means of FIG. 28.

As shown in FIGS. 26 and 27, weaving means 4 and guide means 16 and 17 are provided on a central portion of this apparatus in the same manner as that of the first embodiment. These are different from those of the first embodiment in only one point that carrier members 1 having through holes 19 as shown in FIG. 29 are employed instead of the carrier members 1 as shown in FIG. 8.

A plurality of fibers 5 are wound around a plurality of bobbins 35 respectively, and the bobbins 35 are supported by a bobbin holder 36 on the right side of weaving means 4. Energizing means (not shown) for energizing the fibers 5 so as to be rewinded toward the bobbins 35 are provided on the bobbin holder 36 corresponding to each bobbin 35. A fiber bundling guide 37 is provided between the bobbins 35 and the weaving means 4 to bundle the fibers 5 withdrawn from the bobbins 35.

Each fiber 5 bundled by the fiber bundling guide 37 is passed through the through hole 19 of each carrier member 1, and then each fiber 5 is withdrawn toward the left side of weaving means 4.

Clamping means 38 including a pair of pushing rollers is provided on the left side of the weaving means 4 to clamp a part of a three-dimensional article 2 or 2' woven with the weaving means 4 so that the woven fabric of the three-dimensional article 2 or 2' can not be released.

Transferring means 39 is provided on the left side of the clamping means 38 to transfer the three-dimensional articles 2 and 2' leftward. The transferring means 39 consists of a group of feed rollers 40 and a motor (not shown) for driving the feed rollers 40. If the function of the transferring means 39 is applied to the clamping means 38, it is possible to omit the transferring means 39.

The reed means 8, whose construction is the same as that of the reed means 8 in the first embodiment, is provided between the clamping means 38 and the weaving means 4.

Figure 30:
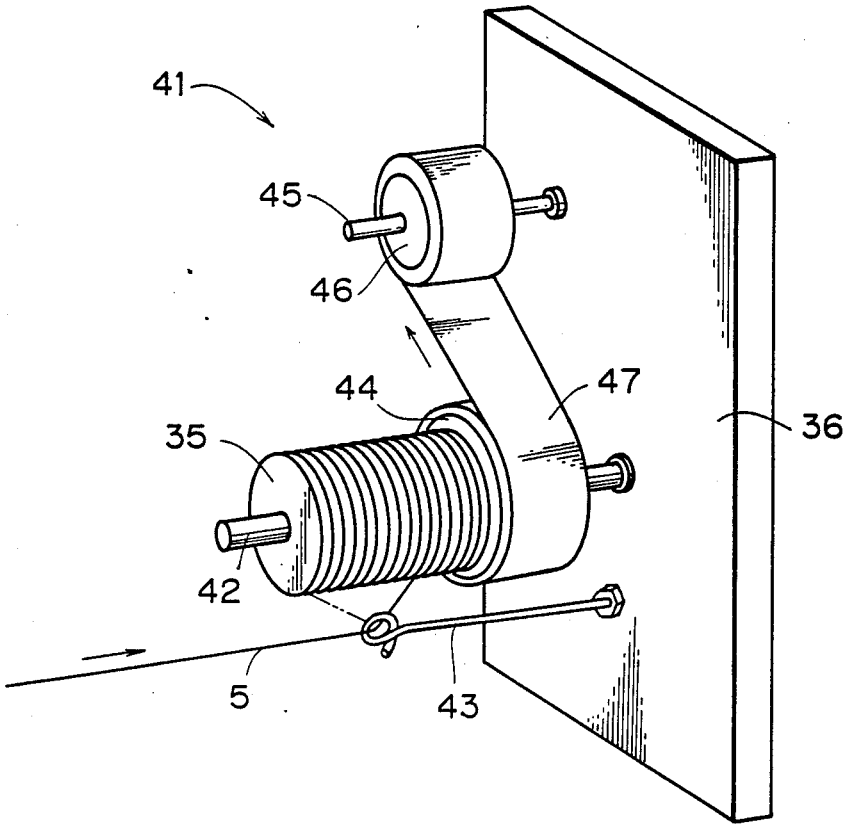
FIG. 30 is a perspective view of an energizing means.

FIG. 30 is a perspective view of the energizing means 41 provided on the bobbin holder 36. As shown in FIG. 30, each bobbin is rotatably supported by an axis 42 fixed on the bobbin holder 36, and each fiber 5 woven around each bobbin 35 is withdrawn through a hook 43 from each bobbin 35. A large diameter drum 44 is fixed on one end of the bobbin 35, while a small-diameter drum 46 is fixed on an axis 45 provided on the bobbin holder 36 which is above the bobbin 35. One end of a band spring 47 is fixed on the small drum 46 so as to be wound around the small drum 46, while the other end of the band spring 47 is fixed on the large drum 44 so as to be wound around the large drum 44, thus rotational force of a rewinding direction is applied to the bobbin 35 by the band spring 47. Where, the band spring 47 is made by a band steel plate and the like, which is extremely small in thickness and is large enough in length so that the weaving operation is not obstructed. Therefore, even if the number of turns of the band spring 47 wound around the large drum 44 increases as the weaving operation advances, the diameter of the band spring 47 wound around the large drum 44 in effect does not change, and therefore a fixed rewinding force is always applied to the bobbin 35 by the band spring 37, whereby the tension applied to the fiber 5 is held at a fixed value.

Reffering to FIG. 27, the apparatus further comprising input means 31 for inputting information and many kinds of commands required for a weaving operation, and control means 32 for controling the weaving means 4, the guide means 16 and 17, the reed means 8, the clamping means 38 and the transferring means 39 on the basis of a program stored in memory means (not shown) in reply to the commands inputted by the input means 31.

Figure 31:
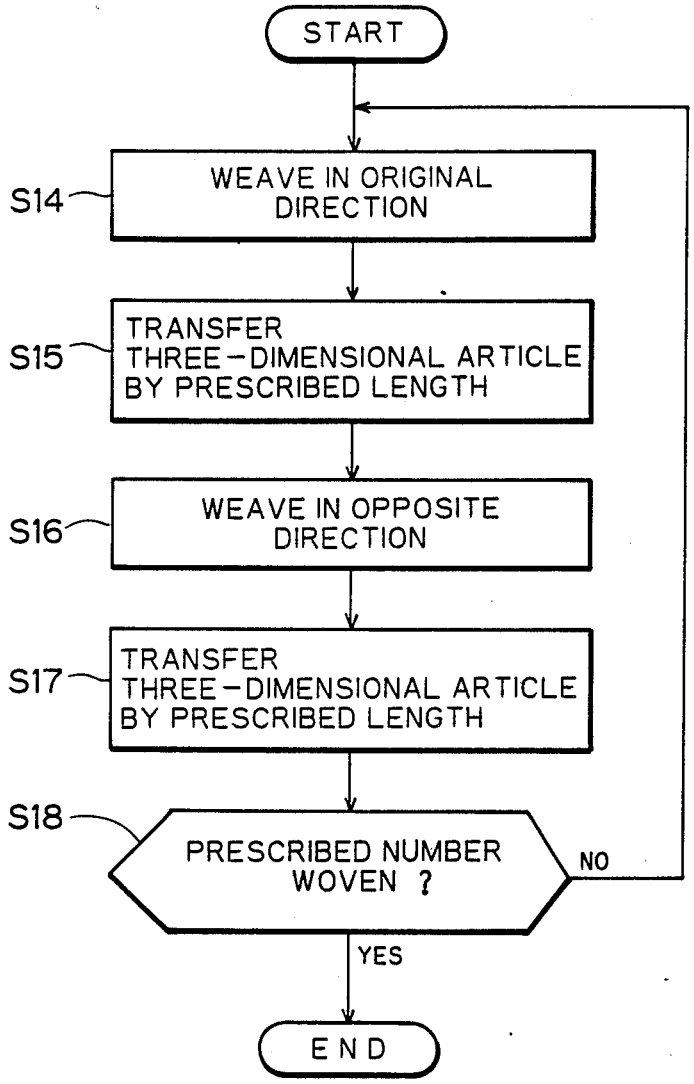
FIG. 31 is a flow chart showing the operation of the second embodiment.

The weaving operation of the apparatus will be described below. As shown in FIG. 27, the fibers 5 withdrawn from the bobbins 35 are passed through the carrier members 1 of weaving means 4 to stretch between the fiber bundling guide 37 and the clamping means 38. In FIG. 27, three-dimensional articles 2 and 2' are woven by a previous weaving operation. Information, for example, the number of the three-dimensional articles 2 and 2' and the like, is inputted by the input means 31, and then a starting command is applied to the input means 31, so that the apparatus starts to drive on the basis of a flow chart as shown in FIG. 31.

Figure 32:
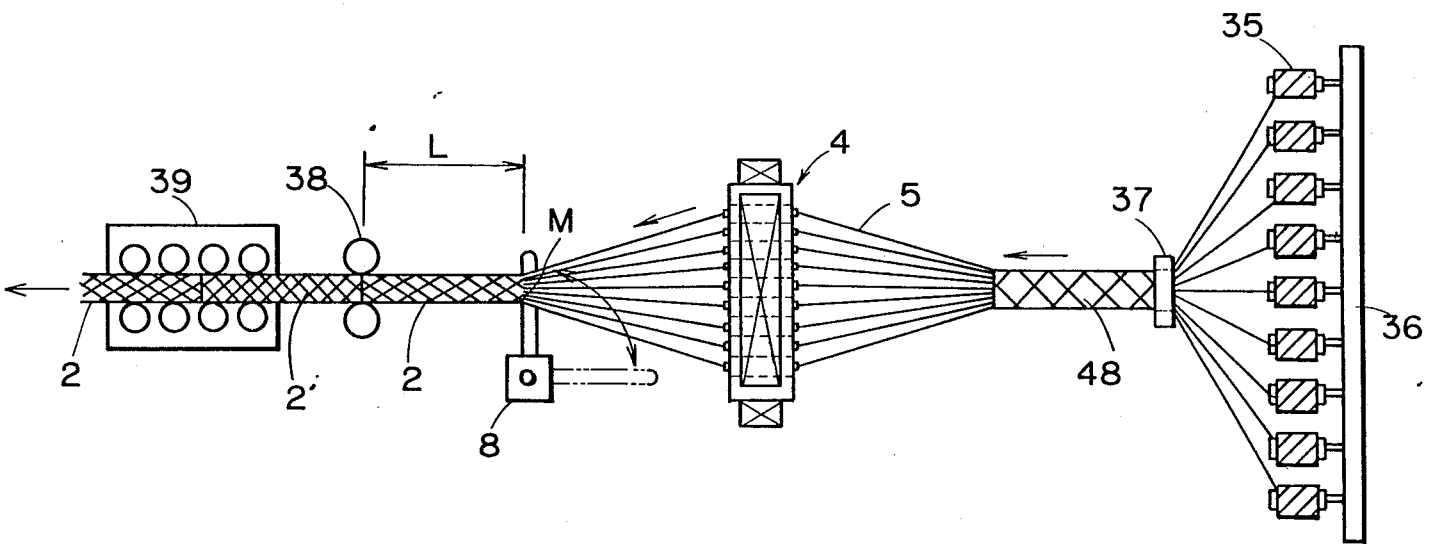
FIGS. 32 to 34 are side views showing the operation of the apparatus respectively.

First, in a step S14, the weaving means 4, the guide means 16 and 17 and the reed means 8 are driven in the same process as that defined by the steps S1 to S13 in FIG. 18, so that three-dimensional articles 2 and 48 are woven on the both sides of the weaving means 4 respectively, as shown in FIG. 32. In this case, the three-dimensional article 2 arranged between the clamping means 38 and the weaving means 4 has a tightly woven fabric because of the reed operation of the reed means 8, while the three-dimensional article 48 (hereafter mentioned as a provisional woven article) arranged between the fiber bundling guide 37 and the weaving means 4 has a loosely woven fabric because of no reed operation. During the weaving operation, the reed means 8 is controlled by the control means 32 so as to move in correspondence with the movement of the interwoven part M in the same manner as that of the first embodiment. Thus, the basic weaving operation is repeated by a prescribed number and L is woven a three-dimensional article 2 having length, and thereafter advance is made to step S15.

Figure 33:
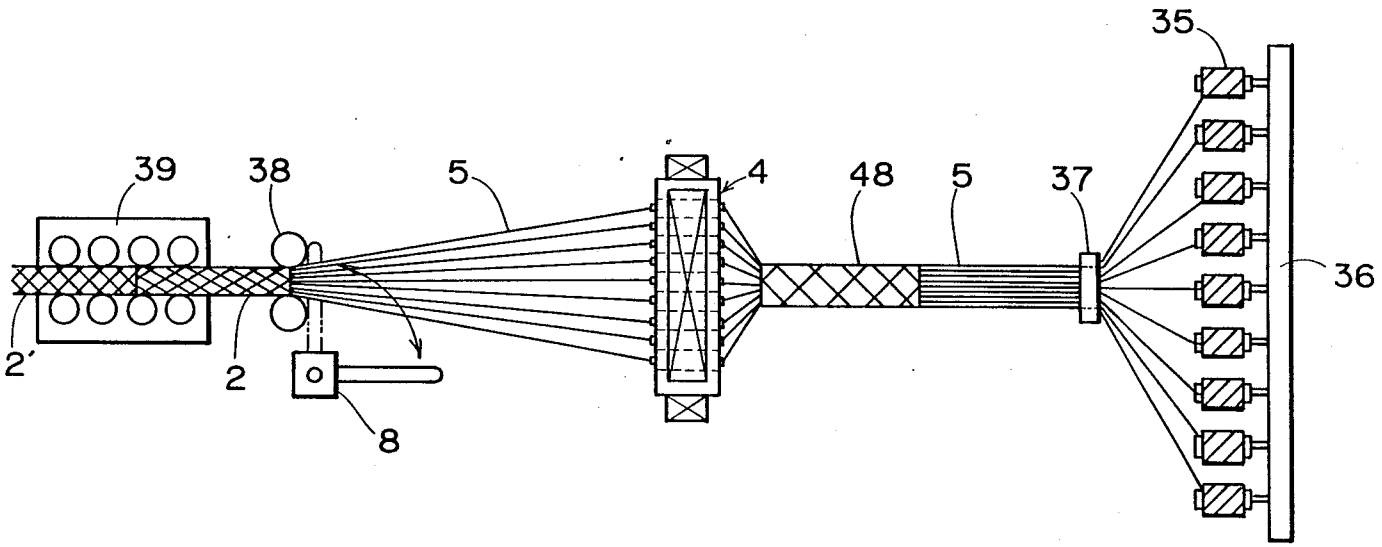

In the step S15, the three-dimensional articles 2 and 2' are transferred leftward the length L by the transferring means 39, and the reed means 8 is returned to an original position thereof as shown in FIG. 33. Then, an end portion of the three-dimensional article 2 shown as an interwoven Part M in FIG. 33, is clamped by the clamping means 38.

Figure 34:
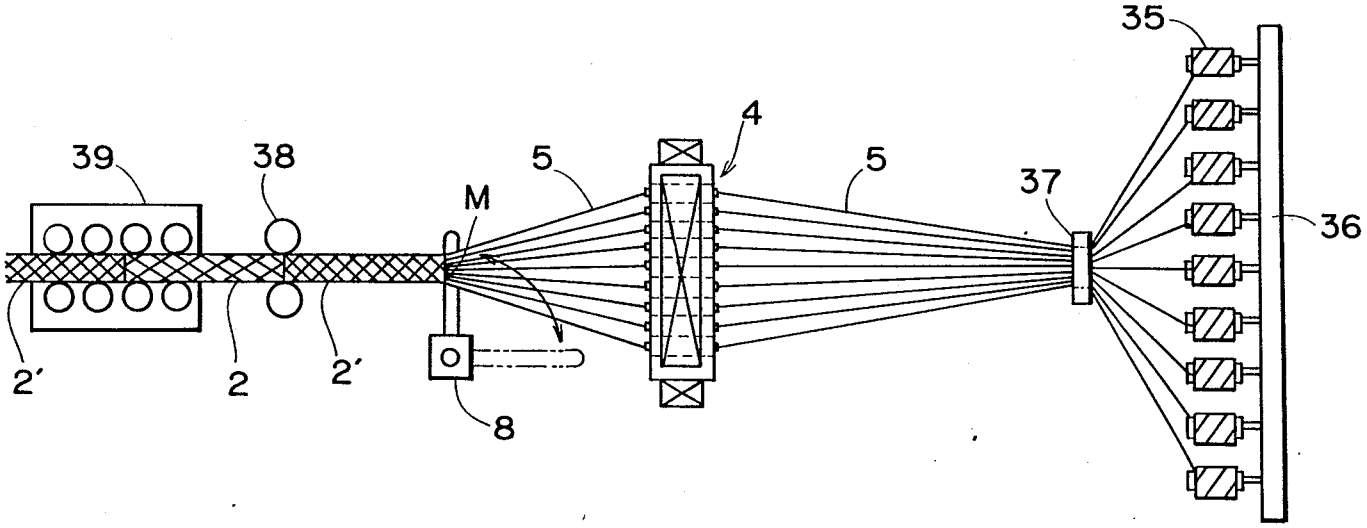

In step S16, the next weaving operation is carried out in the manner of moving the carrier members 1 of the weaving means 4 in the opposite direction to that of the last weaving operation on the basis of the torsion lace method. Namely, the basic weaving operation defined by the steps S10→S11→S12→S7→S8→S9→S4→S5→S6→S1→S2→S3→ of FIG. 18, is repeated by the same number of times as that of the last weaving operation. Thus, the carrier members 1 are moved in the opposite direction, so that the provisional woven article 48 arranged between the fiber bundling guide 37 and the weaving means 4 is released. On the other hand, the three-dimensional article 2 arranged between the weaving means 4 and the clamping means 38 is not released because the end portion thereof is clamped by the clamping means 38, and a new three-dimensional article 2' is woven while being tightened by the reed means 8 as shown in FIG. 34. The woven fabric of the new three-dimensional article 2' is in a striking contrast to that of the three-dimensional article 2 because a moving locus of the carrier members 1 for the three-dimensional article 2' is opposite to that for the three-dimensional article 2. The woven fabric may be slightly loosened or released on a boundary between the three-dimensional articles 2 and 2' according to the construction material of the fibers 5, and therefore it is preferable to prevent the woven fabric from releasing by the means, for example, such as heat fusion welding, curling an adhesive tape around the boundary, curling a braid around the boundary and the like.

Then, in a step S17, the three-dimensional articles 2 and 2' are transferred leftward the length L by the transferring means 39 in the same manner as that of the step S15, to thereby return to the state of FIG. 27. Thereafter, an end portion of the three-dimensional article 2' is clamped by the clamping means 38 to prevent the three-dimensional article 2' from releasing.

In a step S18, it is judged whether the three-dimensional articles 2 and 2' have been woven by a prescribed number or not, and when the same have not been woven by a prescribed number yet, it is returned to the step S14. Thus the above operation is repeated until the same reaches a prescribed number.

According to the weaving apparatus, it is possible to continuously weave the three-dimensional articles 2 and 2', whose length is L, and whose weaving direction is opposite to each other.

Moreover, since the tension is applied to the fibers 5 by the energizing means (FIG. 30), prescribed intertwining force is applied to the interwoven part M by the tension, and therefore it is possible to omit the reed means 8 according to circumstances.

D. Third Embodiment

Figure 35:
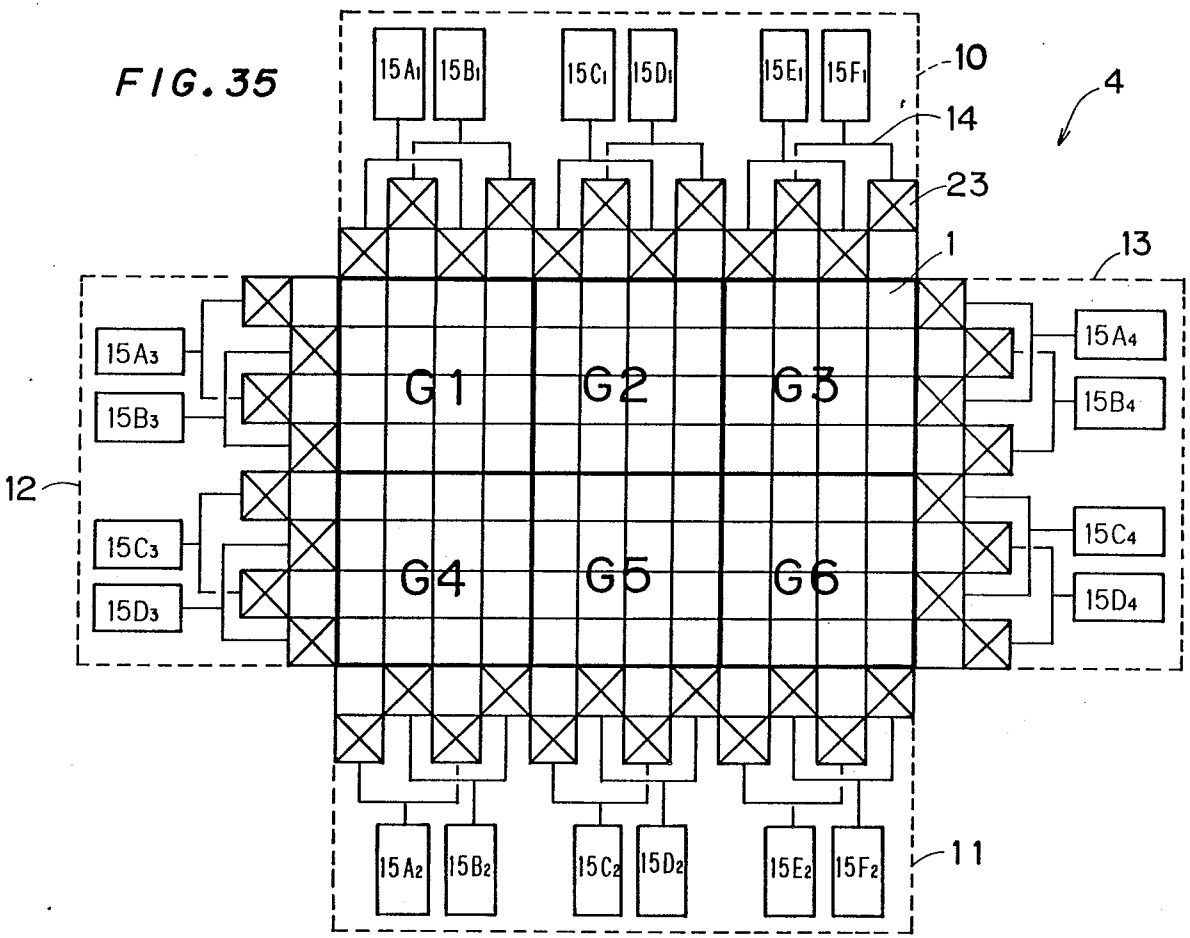
FIG. 35 is a schematic front view of weaving means which is used in the third embodiment of the present invention.

FIG. 35 is a schematic front view of weaving means 4 which is used in the third embodiment of the present invention.

In the weaving means 4, carrier members 1 are arranged in the form of 8 columns and 12 rows, and carrier member drivers 10 to 13 are constituted so that a basic weaving operation can be carried out with each block G1, G2, G3, G4, G5, G6 comprising the carrier members 1 of 4 columns and 4 rows. Namely, the carrier member driver 10 comprises drive means $15A_1$, $15C_1$ and $15E_1$ for downward pushing the carrier members 1 arranged on a pair of odd rows adjoining each other, and drive means $15B_1$, $15D_1$ and $15F_1$ for downward pushing the carrier members 1 arranged on a pair of even rows adjoining each other. Similarly, the carrier member driver 11 comprises drive means $15A_2$, $15C_2$ and $15E_2$ for upward pushing the carrier members 1 arranged on a pair of odd rows adjoining each other, and drive means $15B_2$, $15D_2$ and $15F_2$ for upward pushing the carrier members 1 arranged on a pair of even rows adjoining each other. Further, the carrier member driver 12 comprises drive means $15A_3$ and $15C_3$ for rightward pushing the carrier members 1 arranged on a pair of odd columns adjoining each other, and drive means $15B_3$ and $15D_3$ for rightward pushing the carrier members 1 arranged on a pair of even columns adjoining each other. Similarly, the carrier member driver 13 comprises drive means $15A_4$ and $15C_4$ for leftward pushing the carrier members 1 arranged on a pair of odd columns adjoining each other, and drive means $15B_4$ and $15C_4$ for leftward pushing the carrier members 1 arranged on a pair of even columns adjoining each other.

The other construction of the weaving apparatus comprising the weaving means 4 is the same as that of the weaving apparatus as shown in FIG. 3.

Next, the operation in a case of weaving a three-dimensional article having a special sectional form by the weaving apparatus will be described below. In this case, each operation of guide means 16 and 17 (FIG. 3) and reed means 8 (FIG. 3) carried out in relation to the weaving operation of the weaving means 4 is the same as that in the case of FIG. 3, and therefore only the weaving operation as for the weaving means 4 will be described below. The guide means 16 and 17 and the reed means 18 are not always necessary, and therefore they may be omitted.

Figure 36:
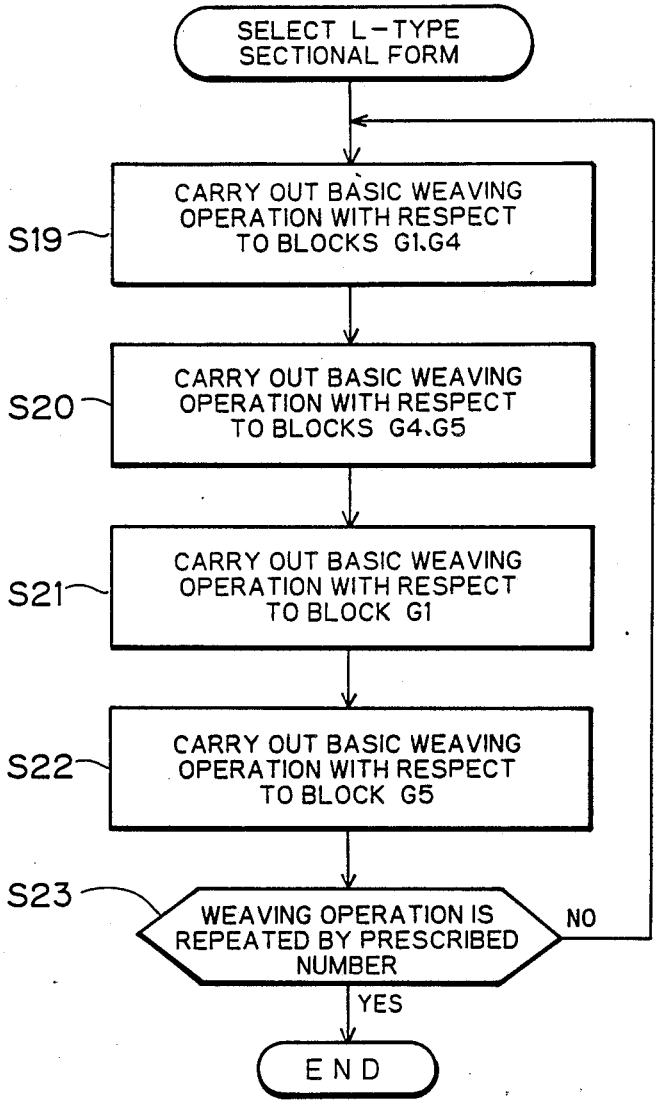
FIG. 36 is a flow chart showing the operation of the third embodiment in a case of weaving a three-dimensional article having an L-type sectional form.
Figure 37:
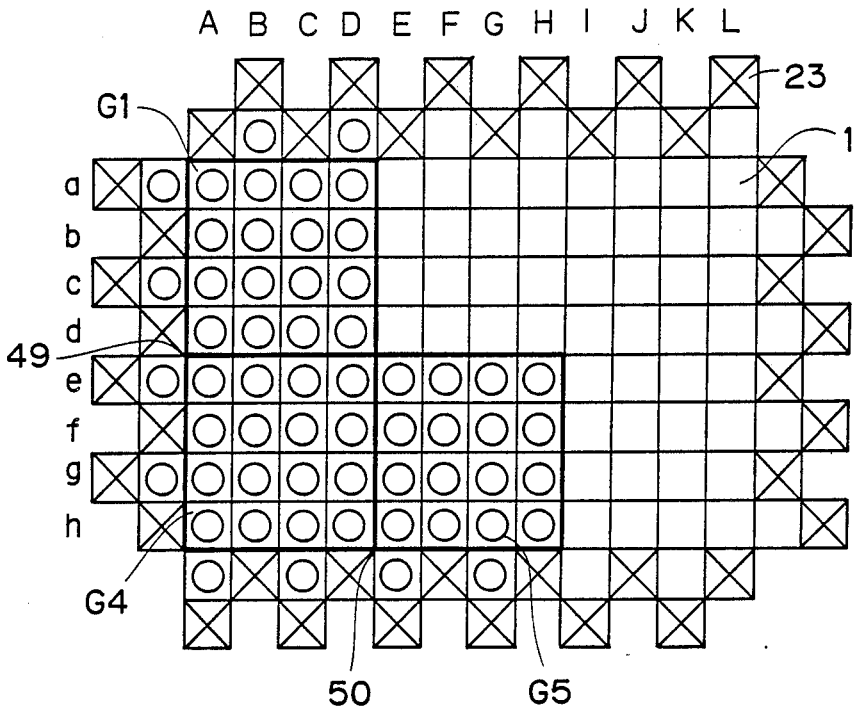
FIG. 37 is a view showing blocks chosen corresponding to the L-type sectional form.
Figure 38:
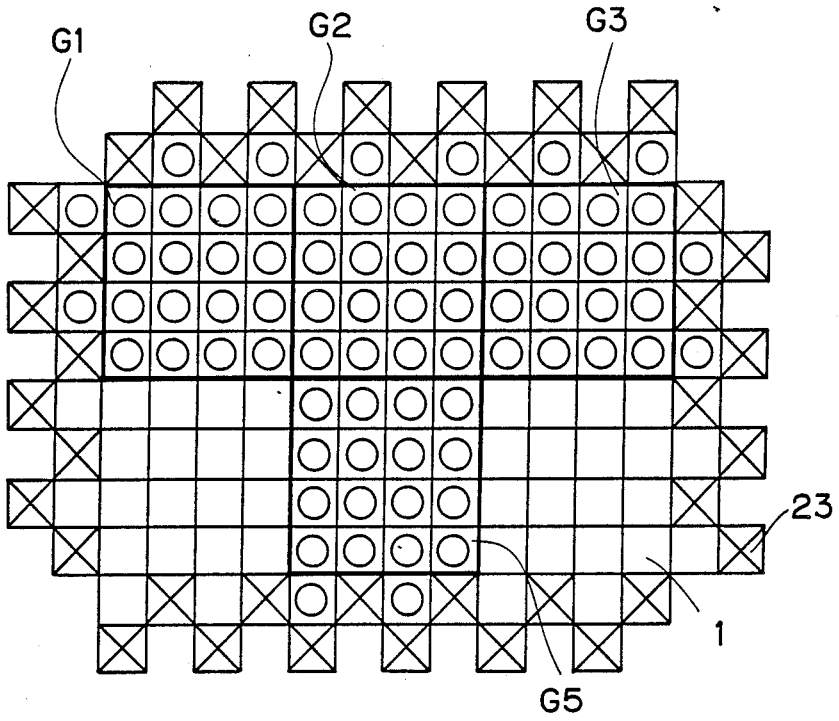
FIG. 38 is a view showing blocks chosen corresponding to a T-type sectional form.

In a case of weaving a three-dimensional article 2 having an L-type sectional form, for example, information required for the weaving operation, such as the data for selecting an L-type sectional form, the number of weaving operation and the like, is inputted by input means 31 (FIG. 3), and then a starting command is applied to the input means 31. In this case, a weaving operation is carried out on the basis of a flow chart as shown in FIG. 36.

In FIGS. 35, 37, 38, 40, 42, 44, 45 and 48, the carrier members 1 are shown by rectangle for convenience, sake, and the carrier members 1 holding the fibers 5 are shown by drawing circles in the rectangles.

First, in a step S19, a basic weaving operation defined by following four steps is carried out at least once, preferably once or twice, with respect to an aggregation of the blocks G1 and G4.

(1) The carrier members 1 of A and C rows (FIG. 37) are moved upward by a prescribed amount, while the carrier members 1 of B and D rows are moved downward by a prescribed amount.

(2) The carrier members 1 of $\bar{a}$, $\bar{c}$, $\bar{e}$ and $\bar{g}$ columns are moved rightward by a prescribed amount, while the carrier members 1 of $\bar{b}$, $\bar{d}$, $\bar{f}$ and $\bar{h}$ columns are moved leftward by a prescribed amount.

(3) The carrier members 1 of A and C rows are moved downward by a prescribed amount, while the carrier members 1 of B and D rows are moved upward by a prescribed amount.

(4) The carrier members 1 of $\bar{a}$, $\bar{c}$, $\bar{e}$ and $\bar{g}$ columns are leftward moved by a prescribed amount, while the carrier members 1 of $\bar{b}$, $\bar{d}$, $\bar{f}$ and $\bar{h}$ columns are moved rightward by a prescribed amount.

Next, in a step S20, a basic weaving operation defined by following four steps is carried out at least once, preferably once or twice, with respect to an aggregation of the blocks G4 and G5.

(1) The carrier members 1 of A, C, E and G rows are moved upward by a prescribed amount, while the carrier members 1 of B, D, F and H rows are moved downward by a prescribed amount.

(2) The carrier members 1 of $\bar{e}$ and $\bar{g}$ columns are moved rightward by a prescribed amount, while the carrier members 1 of $\bar{f}$ and $\bar{h}$ columns are leftward moved by a prescribed amount.

(3) The carrier members 1 of A, C, E and G rows are moved downward by a prescribed amount, while the carrier members 1 of B, D, F and H rows are moved upward by a prescribed amount.

(4) The carrier members 1 of $\bar{e}$ and $\bar{g}$ columns are moved leftward by a prescribed amount, while the carrier members 1 of $\bar{f}$ and $\bar{h}$ columns are moved rightward by a prescribed amount.

Then, in a step S21, a basic weaving operation defined by following four steps is carried out at least once, preferably once or twice, with respect to the block G1.

(1) The carrier members 1 of A and C rows are moved upward by a prescribed amount, while the carrier members 1 of B and D rows are moved downward by a prescribed amount.

(2) The carrier members 1 of $\bar{a}$ and $\bar{c}$ columns are rightward moved by a prescribed amount, while the carrier member 1 of $\bar{b}$ and $\bar{d}$ columns are moved leftward by a prescribed amount.

(3) The carrier members 1 of A and C rows are moved downward by a prescribed amount, while the carrier members 1 of B and D rows are moved upward by a prescribed amount.

(4) The carrier members 1 of $\bar{a}$ and $\bar{c}$ columns are moved leftward by a prescribed amount, while the carrier members 1 of $\bar{b}$ and $\bar{d}$ columns are moved rightward by a prescribed amount.

Next, in a step S22, a basic weaving operation is carried out at least once, preferably once or twice, with respect to the block G5.

(1) The carrier members 1 of E and G rows are moved upward by a prescribed amount, while the carrier members 1 of F and H rows are moved downward by a prescribed amount.

(2) The carrier members 1 of $\bar{e}$ and $\bar{g}$ columns are moved rightward by a prescribed amount, while the carrier members 1 of $\bar{f}$ and $\bar{h}$ columns are moved leftward by a prescribed amount.

(3) The carrier members 1 of E and G rows are moved downward by a prescribed amount, while the carrier members 1 of F and H rows are upward moved by a prescribed amount.

(4) The carrier members 1 of $\bar{e}$ and $\bar{g}$ columns are moved leftward by a prescribed amount, while the carrier members 1 of $\bar{f}$ and $\bar{h}$ columns are moved rightward by a prescribed amount.

Thereafter, in a step S23, it is judged whether the weaving operation defined by the steps S19 to S22 has been repeated by a prescribed number or not, and when the same has not been repeated by a prescribed number yet, it is returned to the step S19 in order to repeat the weaving operation. Thus, in the step S23, when it is confirmed that the weaving operation has been repeated by the prescribed number, the weaving operation completes.

According to the weaving method, the carrier members 1 of the blocks G1, G4 and G5 are moved only within the aggregated area of the blocks G1, G4 and G5 to intertwine the fibers 5 with each other, while preventing the carrier members 1 of the blocks G2, G3 and G6 from moving to the blocks G1, G4 and G5, whereby a three-dimensional article 2 having an L-type sectional form corresponding to the aggregated area of the blocks G1, G4 and G5 are woven.

It is also possible to weave a three-dimensional article 2 having an L-type sectional form in such a manner that, after choosing the blocks G1, G4 and G5, the basic weaving operation is sequentially and alternately carried out with respect to the individual blocks G1, G4 and G5. In such a manner, however, band-shaped tiers are formed along a boundary part 49 (FIG. 37) between the blocks G1 and G4 and a boundary part 50 between the blocks G4 and G5, respectively. In contrast to that, since, in the above weaving method, the basic weaving operation is carried out with respect to the aggregated area of the blocks G1 and G4 and the aggregated area of the blocks G4 and G5, the size of the tiers of the boundary parts 49 and 50 can be decreased.

It is also possible to weave a three-dimensional article 2 having an L-type sectional form in such a manner that, in the above weaving method, the steps S12 and S22 of FIG. 36 are omitted. In such a manner, however, the number of the basic weaving operation for the block G4 is larger than that for the blocks G1 and G5, and therefore a weaving density corresponding to the blocks G4 gets larger than that corresponding to the blocks G1 and G5. In contrast to that, the above weaving method comprises the steps S21 and S22 in order to equalize the numbers of weaving operations with respect to the individual blocks G1, G4 and G5, whereby a uniform weaving density can be obtained over the whole area of a section of the three-dimensional article 2.

Figure 39:
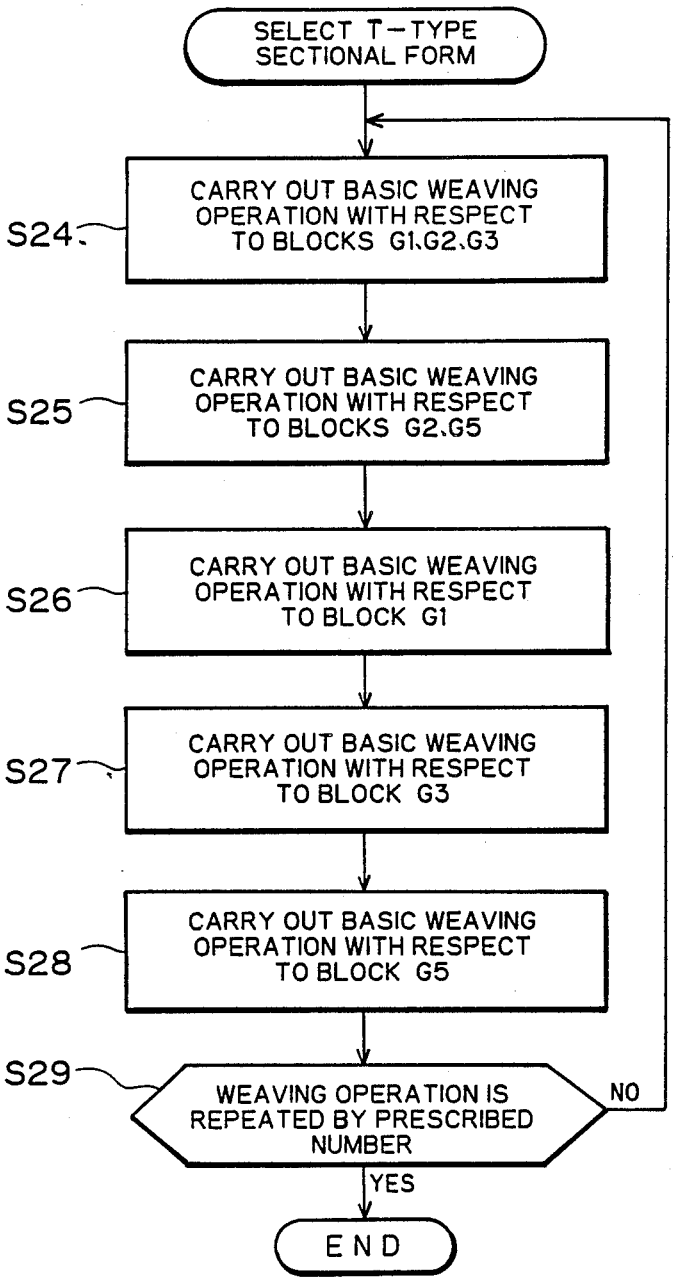
FIG. 39 is a flow chart showing the operation of the third embodiment in a case of weaving a three-dimensional article having a T-type sectional form.
Figure 40:
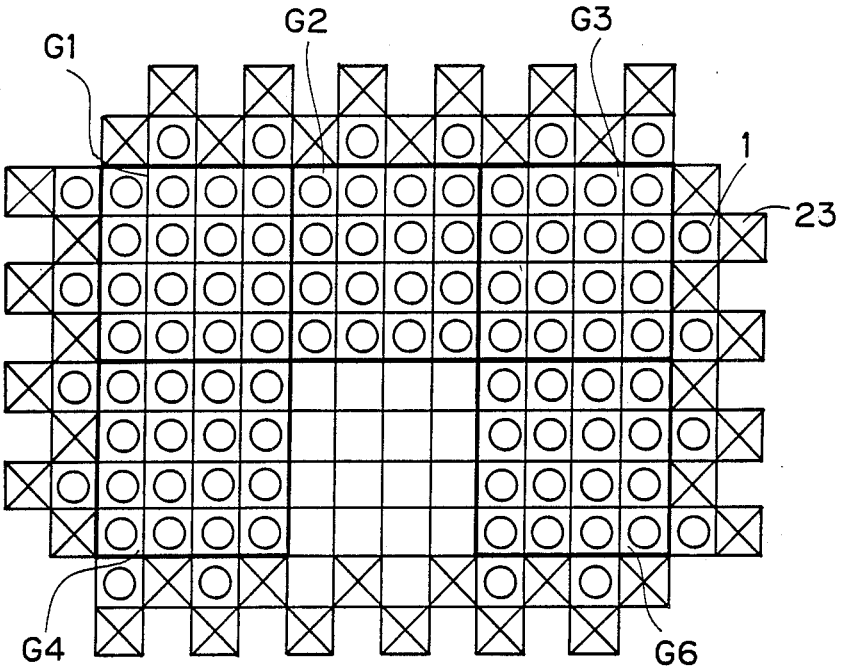
FIG. 40 is a view showing blocks chosen corresponding to a C-type sectional form.

On the other hand, when information for selecting a T-type sectional form is inputted by the input means 31 (FIG. 3), a weaving operation is carried out with respect to the blocks G1, G2, G3 and G5 on the basis of a process as shown in FIG. 39 to weave a three-dimensional article 2 having a T-type sectional form.

First, a basic weaving operation is carried out with respect to an aggregated area of the blocks G1, G2 and G3 in a step S24, and then a basic weaving operation is carried out with respect to an aggregated area of the blocks G2 and G5 in a step S25. Thereafter, basic weaving operations are sequentially carried out with respect to the individual blocks G1, G3 and G5 in steps S26 to S28. In this case, it may be employed to simultaneously carry out the weaving operations of the steps S26 and S27. Then, the number of the weaving operation is judged in a step S29, and the weaving operation defined by the steps S24 to S28 is repeated until the same reaches a prescribed number. Thus, a three-dimensional article 2 having a T-type sectional form corresponding to an aggregated area of the blocks G1, G2, G3 and G5 is woven.

Figure 41:
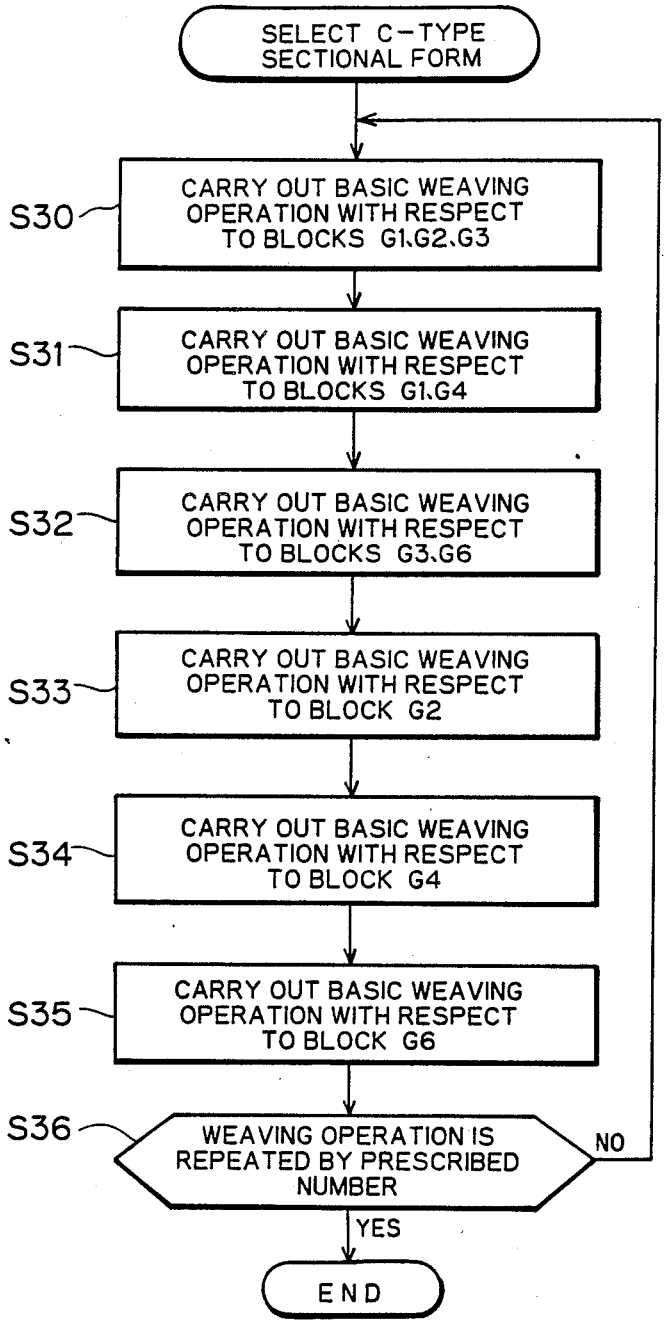
FIG. 41 is a flow chart showing the operation of the third embodiment in a case of weaving a three-dimensional article having a C-type sectional form.

Further, when information for selecting a C-type sectional form is inputted by the input means 31 (FIG. 3), a weaving operation is carried out with respect to the blocks G1, G2, G3, G4 and G6 on the basis of a process as shown in FIG. 41, to weave a three-dimensional article 2 having a C-type section form.

First, a basic weaving operation is carried out with respect to an aggregated area of the blocks G1, G2 and G3 in a step S30, and then a basic weaving operation is carried out with respect to an aggregated area of the blocks G1 and G4 in a step S31, and thereafter a basic weaving operation is carried out with respect to an aggregated area of the blocks G3 and G6 in a step S32. In this case, it may be employed to simultaneously carry out the weaving operations of the steps S31 and S32. Then, basic weaving operations are sequentially carried out with respect to the individual blocks G2, G4 and G6 in steps S33 to S35. In this case, one may elect to simultaneously carry out the weaving operations of the steps S34 and S35. Thereafter, the number of the weaving operation is judged in a step S36, and the weaving operation defined by the steps S30 to S35 is repeated until the same reaches a prescribed number. Thus, a three-dimensional article 2 having a C-Type sectional form corresponding to an aggregated area of the blocks G1, G2, G3, G4 and G6 is woven.

According to the weaving apparatus, it is possible to weave many kinds of three-dimensional articles 2 having voluntary sectional forms which are formed by a combination of the blocks G1 to G6. In other words, it is possible to weave many kinds of three-dimensional articles 2 having different sectional forms by using a low-cost weaving apparatus, while not changing the layout of the carrier member drivers 10 to 13 and the like.

E. Fourth Embodiment

Figure 42:
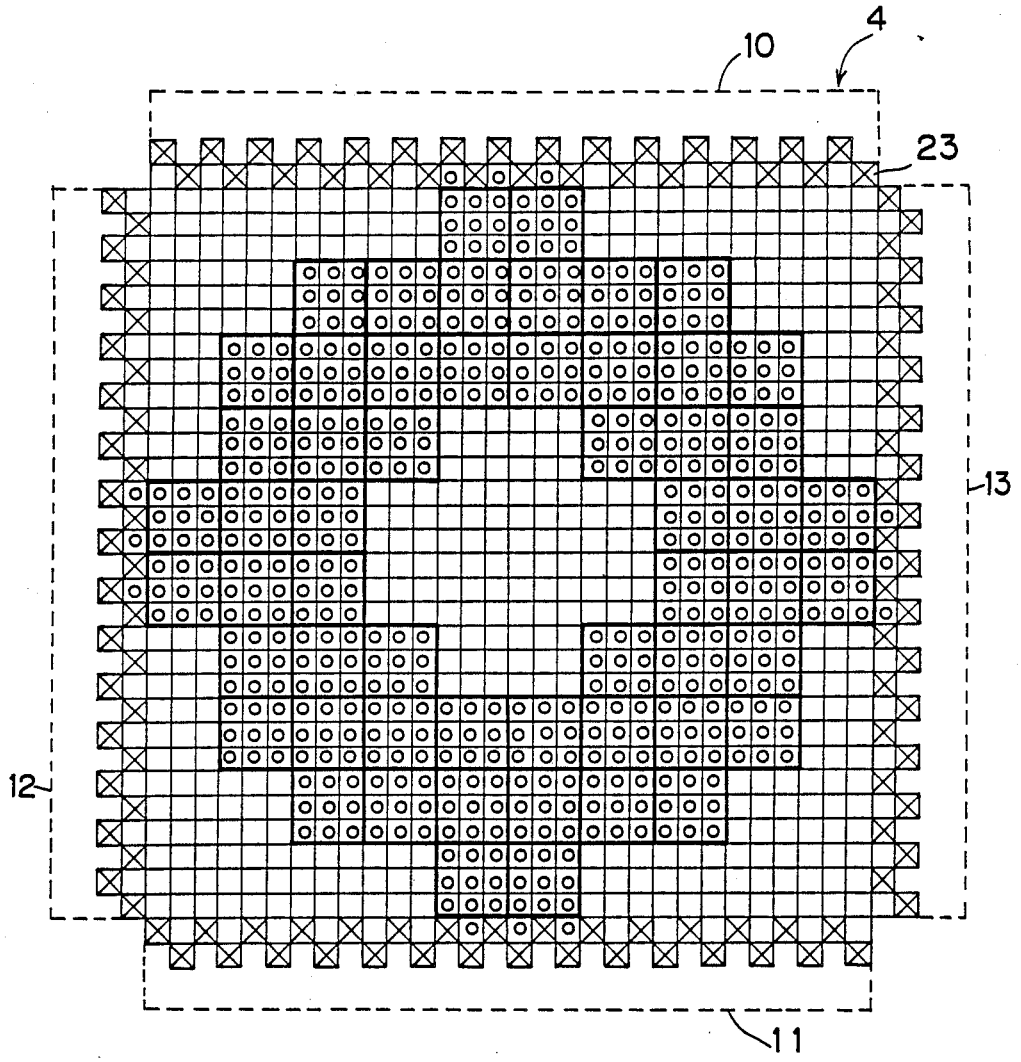
FIG. 42 is a schematic front view of weaving means which is used in the fourth embodiment of the present invention.

FIG. 42 is a schematic front view of weaving means 4 which is used in the fourth embodiment of the present invention.

In the weaving means 4, carrier members 1 are arranged in the form of 30 columns and 30 rows, and carrier member drivers 10 to 13 are constituted so that a basic weaving operation can be carried out with each block comprising the carrier members 1 of 3 columns and 3 rows. The other construction of the weaving apparatus comprising the weaving means 4 is the same as that of the third embodiment.

Figure 44:
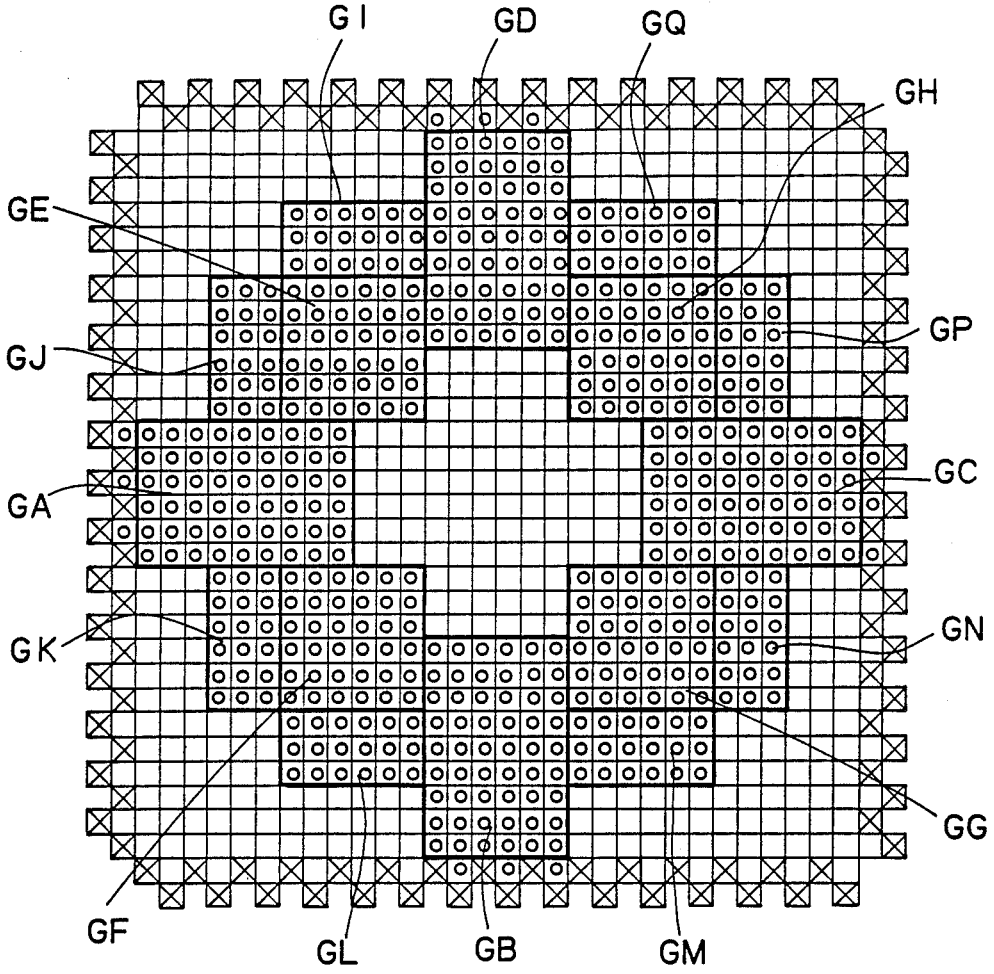
FIG. 44 is a view showing chosen blocks corresponding to the ring-type sectional form.
Figure 43:
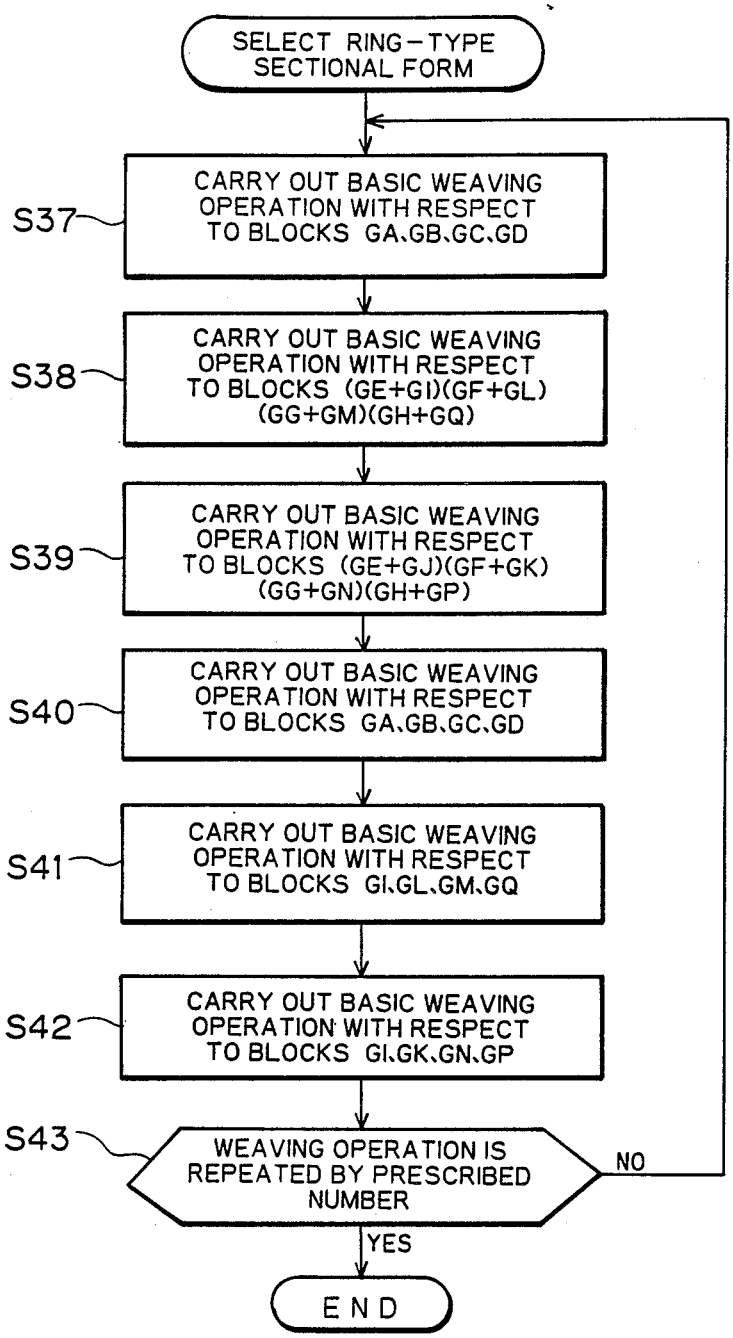
FIG. 43 is a flow chart showing the operation of the fourth embodiment in a case of weaving a three-dimensional article having a ring-type sectional form.

In the weaving apparatus, when information for selecting a ring-type sectional form is inputted by the input means, a weaving operation is carried out with respect to fifty-six blocks enclosed by heavy lines in FIG. 42, on the basis of a process as shown in FIG. 43 to weave a three-dimensional article 2 having a ring-type sectional form. In this case, a basic weaving operation is carried out with each block corresponding to sixteen blocks GA, GB, GC, GD, GE, GF, GG, GH, GI, GJ, GK, GL, GM, GN, GP and GQ as shown in FIG. 44, which are defined by combination fifty-six blocks of FIG. 42.

First, in a step S37, basic weaving operations are carried out with respect to the individual blocks GA, GB, GC and GD, respectively. Then, in a step S38, basic weaving operations are carried out with respect to individual aggregated areas of the blocks GE and GI, the blocks GF and GL, the blocks GG and GM, and the blocks GH and GQ, respectively. Thereafter, in a step S39, basic weaving operations are carried out with respect to individual aggregated areas of the blocks GE and GJ, the blocks GF and GK, the blocks GG and GN, and the blocks GH and GP, respectively. Next, in a step S40, basic weaving operations are carried out again with respect to the individual blocks GA, GB, GC and GD, respectively, and then, in a step S41, basic weaving operations are carried out with respect to the individual blocks GI, GL, GM and GQ, respectively, and thereafter, in a step S42, basic weaving operations are carried out with respect to the individual blocks GJ, GK, GN and GP, respectively. Next, the number of the weaving operation is judged in a step S43, and the weaving operation defined by steps S37 to S42 is repeated until the same reaches a prescribed number. Thus a three-dimensional article 2 having a ring-type sectional form corresponding to an aggregated area of fifty-six blocks enclosed by the heavy lines in FIG. 42, is woven.

According to the weaving apparatus, it is possible to weave many kinds of the three-dimensional articles 2 having special sectional forms such as I-type, L-type, J-type, H-type, C-type, ring-type and the like. In a case of weaving the three-dimensional articles 2 having the same-type sectional forms, it is also possible to voluntarily weave the three-dimensional articles 2 having different numbers of fibers corresponding to the number of the chosen blocks.

Figure 45:
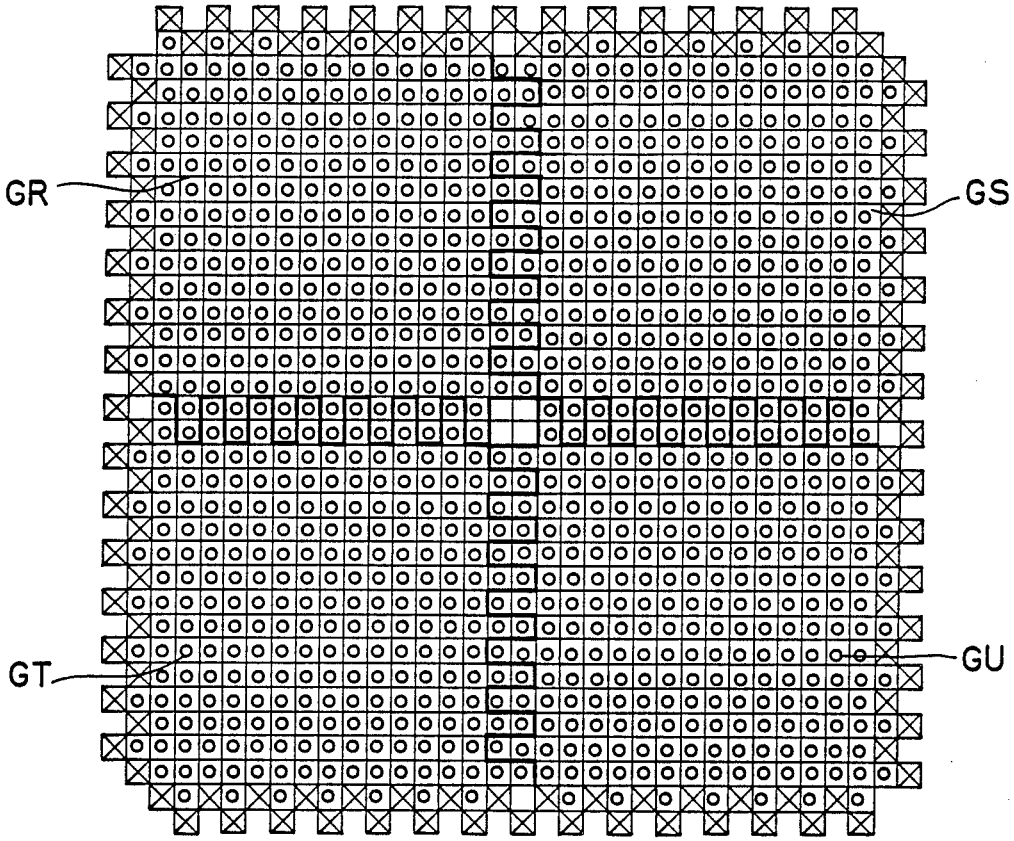
FIG. 45 is a view showing blocks chosen for weaving a three-dimensional article having branching parts.
Figure 46:
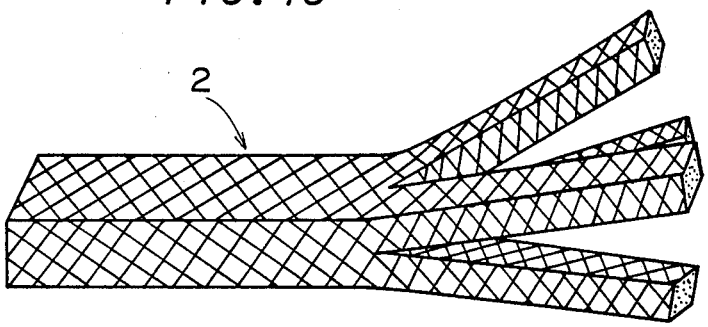
FIG. 46 is a perspective view showing a three-dimensional article having branching parts.
Figure 47:
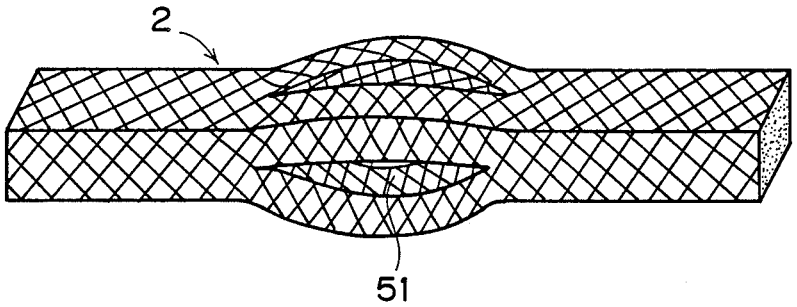
FIG. 47 is a perspective view showing a three-dimensional article having a perforated part.

In the above weaving means 4, it is possible to weave a three-dimensional article 2 having four branching parts as shown in FIG. 46 in such a manner as, with segmenting an area of the carrier members 1 arranged in the form of 30 columns and 30 rows into four blocks GR, GS, GT and GU along heavy lines as shown in FIG. 45, basic weaving operation is repeated by a prescribed number with respect to an aggregated area of the blocks GR, GS, GT and GU, and thereafter basic weaving operations are repeated by prescribed numbers with respect to the individual blocks GR, GS, GT and GU, respectively. It is also possible to weave a three-dimensional article 2 having a perforated part 51 as shown in FIG. 47 in such a manner as, after weaving the branching parts in FIG. 46, basic weaving operation is repeated with respect to the aggregated area of the blocks GR, GS, GT and GU.

F. Fifth Embodiment

Figure 48:
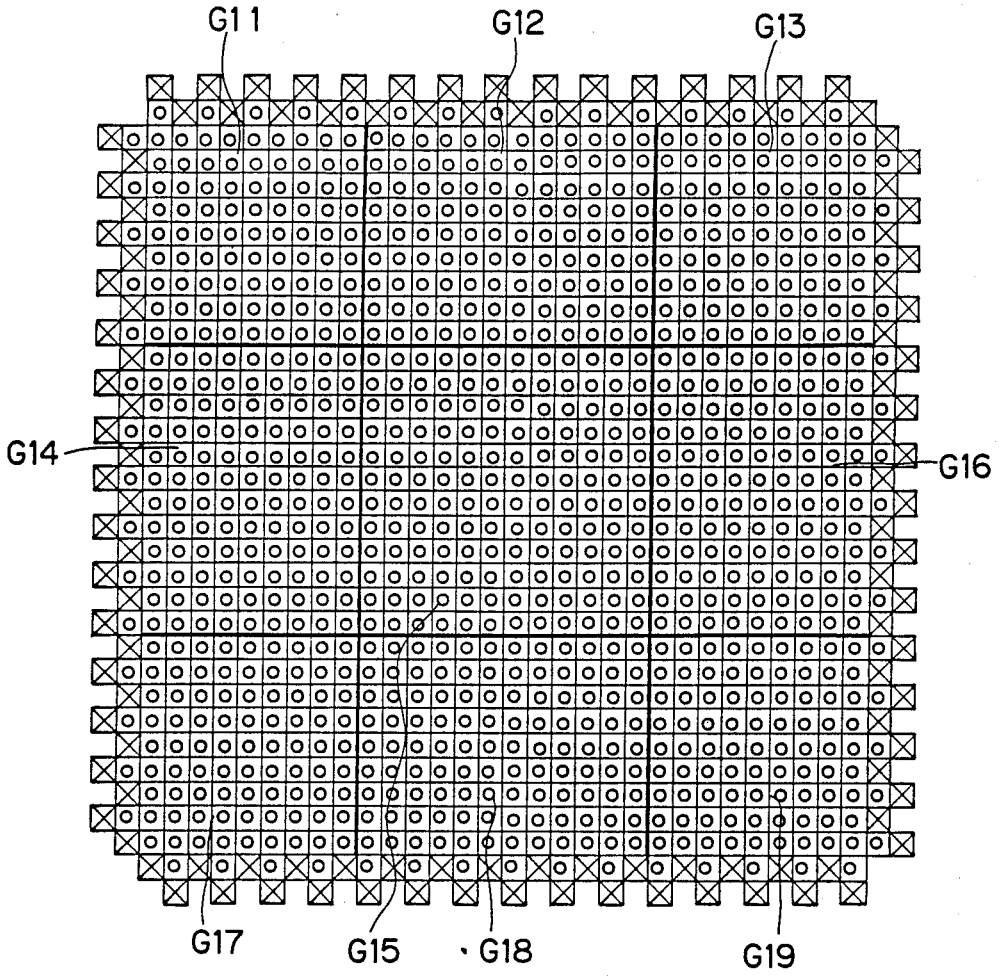
FIG. 48 is a view showing blocks chosen for changing a weaving density of a three-dimensional article.

FIG. 48 is a schematic front view of weaving means 4 which is used in the fifth embodiment of the present invention. The weaving means 4 is equal to the weaving means 4 of the fourth embodiment, and the other construction of the weaving apparatus comprising the weaving means 4 is the same as that of the fourth embodiment.

Figure 49:
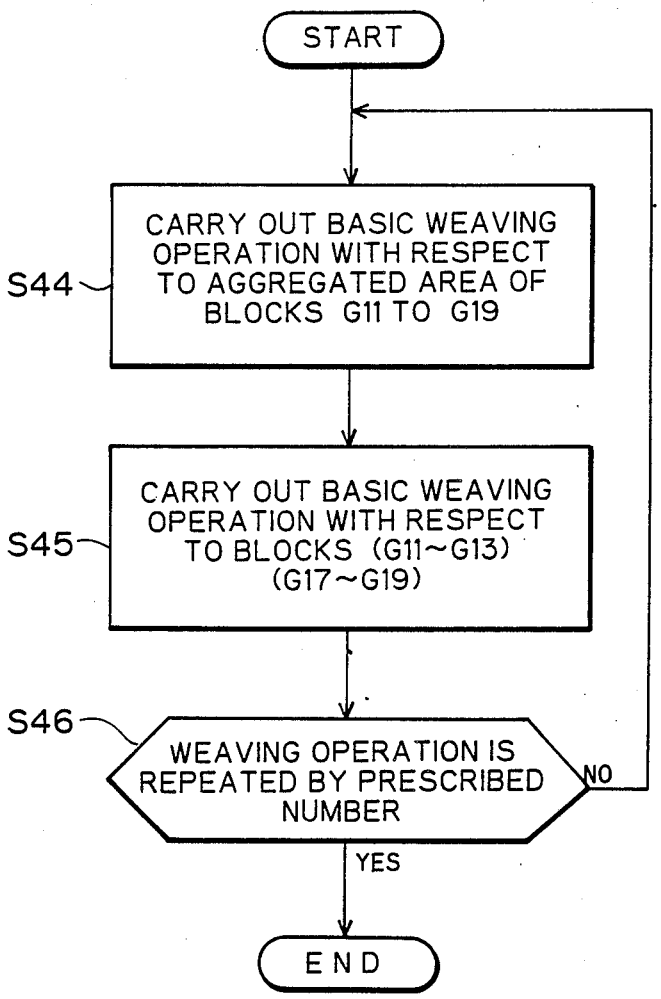
FIG. 49 is a flow chart showing an example of the operation in a case of weaving a three-dimensional article having a different weaving density in part in the fifth embodiment.

In the weaving apparatus, when, by the input means, it os inputted such information as weaving densities of an upper and a lower areas within a cross section of a three-dimensional article 2 are set to be larger than that of a middle area within the cross section of the three-dimensional article 2, a weaving operation is carried out with respect to nine blocks enclosed by heavy lines in FIG. 48, on the basis of a process as shown in FIG. 49.

Figure 50:
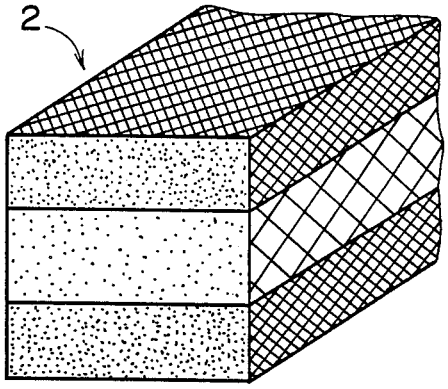
FIG. 50 is a perspective view showing a three-dimensional article woven according to the procedure as shown in FIG. 49.

Namely, a basic weaving operation is once carried out with respect to an aggregated area of the blocks G11 to G19 (a step S44). Next, basic weaving operations are carried out at least once with respect to an aggregated area of the blocks G11, G12 and G13 and an aggregated area of the blocks G17, G18 and G19, respectively (a step S45). Then, the number of the weaving operation is judged in a step S46, and the weaving operation defined by the steps S44 and S45 is repeated until the same reaches a prescribed number. Thus, a three-dimensional article 2 in which the weaving densities of the upper and the lower areas within the cross section thereof are larger than that of the middle area within the cross section thereof, is woven as shown in FIG. 50.

Figure 51:
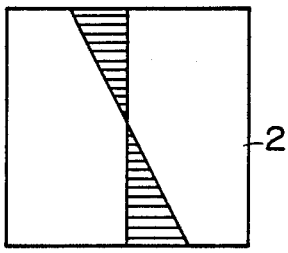
FIG. 51 is a view showing the distribution of bending stress operating with respect to a composite article.

In a case of forming a composite material such as FRP and the like, by employing the three-dimensional srticle 2 thus woven, when bending stress is applied to the composite material, the bending stress in peripheral parts of the composite material is larger than that in a middle part of the composite material as shown in FIG. 51. Therefore, if the weaving densities, in the areas to which the bending stress strongly applies, are set high as shown in FIg. 50, it is possible to increase the rupture strength of the composite material.

Figure 52:
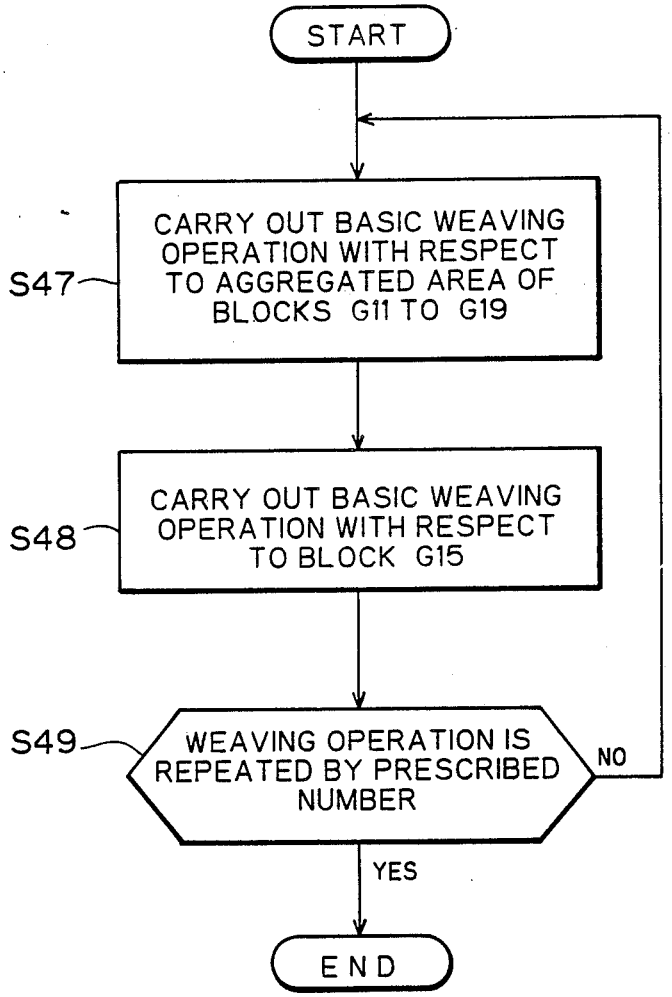
FIG. 52 is a flow chart showing the other example of the operation in a case of weaving a three-dimensional article having a varied weaving density in the fifth embodiment.

On the other hand, in the weaving apparatus, when, by the input means, it is inputted such information as weaving density of a central area within a cross section of a three-dimensional article 2 is set to be larger than that of a peripheral area within the cross section of the three-dimensional article 2, a weaving operation is carried out with respect to nine blocks G11 to G19 enclosed by the heavy lines in FIG. 48, on the basis of a process as shown in FIG. 52.

Figure 53:
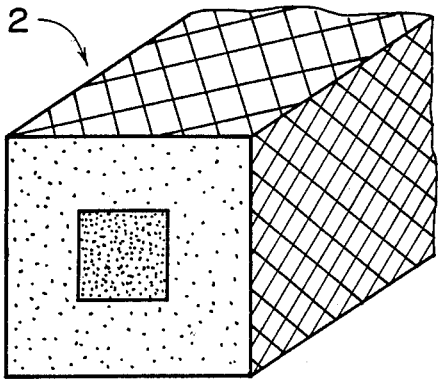
FIG. 53 is a perspective view showing a three-dimensional article woven according to the procedure as shown in FIG. 52.

Namely, a basic weaving operation is once carried out with respect to an aggregated area of the blocks G11 to G19 (a step S47). Next, a basic weaving operation is carried out at least once with respect to the block G15 (a step S48). Then, the nuumber of the weaving operation is judged in a step S49, and the weaving operation defined by the stepa S47 and S48 is repeated until the same reaches a prescribed number. Thus, a three-dimensional article 2 having a strong center part is woven as shown in FIG. 53, in which the weaving density of the central area within the cross section thereof is larger than that of the peripheral area within the cross section thereof.

It is possible to weave many kinds of three-dimensional articles 2 having different weaving density distributions by suitably selecting the prescribed blocks whose number of the weaving operations is set to be large, within the blocks G11 to G19.

In FIG. 48, the fibers 5 are held by the carrier members 1 of all of the blocks G11 to G19 to weave the three-dimensional article 2 having the different weaving density in part, but the fibers 5 may be held by the carrier members 1 of specific blocks to weave a three-dimensional srticle 2 having a different weaving density in part.

G. The Other Embodiments

In the above third to fifth embodiments, the weaving methods thereof are employed in the weaving apparatus which simultaneously weaves two three-dimensional articles 2 on the both sides of the weaving means 4 as shown in FIG. 3, but the weaving methods according to the above third to fifth embodiments may by employed in the weaving apparatus which continuously weaves a three-dimensional articel 2 as shown in FIG. 27. The weaving methods according to the above third to fifth embodiments may be carried out by employing weaving means 4 that bobbins are loaded on the carrier members 1.

Although the present invention has been described and illustrated in detail, it is clearly understood that the same is for illustration and example only and is not limited to the discussion herein the spirit and scope of the present invention being limited only by the terms of the appended claims.

What is claimed is:

1. A method of weaving a three-dimensional srticle from a plurality of fibers with weaving means having a plurality of carrier members, said method comprising:

(a) arranging said carrier members in the form of a matrix, choosing and grouping said carrier members in said matrix to make a plurality of blocks in a manner that each of said blocks is adjacent to at least one remaining said blocks, in each of which blocks the chosen carrier members are arranged in a form of rectangular formation so that a formation depicted by all of said chosen carrier members forms a pattern corresponding to a cross-sectional form of said three-dimensional article; and (b) supporting said fibers only to said chosen carrier members in said matrix, and performing sequentially a basic weaving operation, which consists of steps defined by the following steps of from (b-1) to (b-4) at one of said blocks and performing the same at every block in order;

(b-1) moving said carrier members arranged at even rows and said carrier members arranged at odd rows respectively in the opposite direction along said row direction by a perdetermined amount, (b-2) moving said carrier members arranged at even columns and said carrier members arranged at odd columns respectively in the opposite direction along said column direction by a predetermined amount, (b-3) moving said carrier members arranged at the even rows and said carrier members arranged at the odd rows in the opposite direction to that in said step (b-1) by a predetermined amount, and (b-4) moving said carrier members arramged at the even columns and said carrier members arranged at the odd columns in the opposite direction to that in said step (b-2) by a predetermined amount.

2. A method of weaving a three-dimensional article from a plurality of fibers with weaving means having a plurality of carrier members, said apparatus comprising:

(a) arranging said carrier members in the form of a matrix, choosing and grouping said carrier members in said matrix to make a plurality of blocks in a manner that predetermined two blocks chosen from said blocks are partially overlapped each other, in each of which blocks the chosen carrier members are arranged in a form of rectangular formation so that a formation depicted by all of said chosen carrier members forms a pattern corresponding to a cross-sectional form of said three-dimensional article;

(b) supporting said fibers only to said chosen carrier members in said matrix, and performing sequentially a basic weaving operation, which consists of steps defined by the following steps of from (b-1) to (b-4) at one of said blocks and performing the same at every block in order;

(b-1) moving said carrier members arranged at even rows and said carrier members arranged at odd rows respectively in the opposite direction along said row direction by a predetermined amount, (b-2) moving said carrier members arranged at even columns and said carrier members arranged at odd columns respectively in the opposite direction along said column direction by a predetermined amount, (b-3) moving said carrier members arranged at the even rows and said carrier members arranged at the odd rows in the opposite direction to that in said step (b-1) by a predetermined amount, and (b-4) moving said carrier members arranged at the even columns and said carrier members arranged at the odd columns in the opposite direction to that in said step (b-2) by a predetermined amount; and (c) adjusting the numbers of the basic weaving operations of said chosen carrier members located at a portion where one of said blocks is overlapped with another said blocks and at a portion where one of said blocks has no overlapping with another said blocks at the same numbers by controlling the number of times of said moving of said carrier members in the row direction and in the column direction.

3. A method of weaving a three-dimensional article in accordance with claim 1, further comprising the step of:

performing said basic weaving operation a different number of times on said chosen predetermined blocks than on the other blocks of said plurality of blocks by controlling the number of times of said moving of said carrier members in the row direction and in the column direction.

4. Apparatus for weaving a three-dimensional article from a plurality of fibers, said apparatus comprising:

weaving means, having a plurality of carrier members arranged in the form of a matrix, for interweaving said fibers by alternately moving said carrier members along a column direction and a row direction of said matrix;

first guide means for inserting in and extracting from between said carrier members adjoining each other along the row direction;

second guide means for inserting in and extracting from between said carrier members adjoining each other along the column direction; and control means for controlling said weaving means, said first guide means and said second guide means;

said control means further comprising:

first control means for inserting said first guide means in between said carrier members, while extracting said second guide means from between said carrier members, second control means for moving said carrier members arranged at even rows and said carrier members arranged at odd rows respectively in the opposite direction along row direction by a perscribed amount, after completing a control operation of said first control means, third control means for inserting said second guide means in between said carrier members, while extracting said first guide means from between said carrier members, after completing a control operation of said second control means, fourth control means for moving said carrier members arranged at even columns and said carrier members arranged at odd columns respectively in the opposite direction along said column direction by a prescribed amount, after completing a control operation of said third control means, fifth control means for inserting said first guide means in between said carrier members, while extracting said second guide means from between said carrier members, after completing a control operation of said fourth control means, sixth control means for moving said carrier members arranged at the even rows and said carrier members arranged at the odd rows in the opposite direction to that in said second control means by a prescribed amount, after completing a control operation of said fifth control means, seventh control means for inserting said second guide means in between said carrier members, while extracting said first guide means from between said carrier members, after completing a control operation of said sixth control means, and eighth control means for moving said carrier members arranged at the even columns and said members arranged at the odd columns in the opposite direction to that in said fourth control means by a prescribed amount, after completing a control operation of said seventh control means.

5. Apparatus for weaving a three-dimensional article in accordance with claim 4, wherein each said carrier members has a rod-shaped body, having a through hole in the center thereof, whose cross section is a circle, and wherein a plurality of depressions capable of passing through said first and second guide means are respectively provided in the direction perpendicular to the longitudinal direction of said body on a circumferential surface of said body.

6. Apparatus for weaving a three-dimensional article in accordance with claim 4, wherein each said carrier member has a rod-shaped body, having a through hole in the center thereof, whose cross section depicts a shape in which the upper and the lower regions of a circle are removed, and wherein a plurality of depressions capable of passing through said first and second guide means are respectively provided in the direction perpendicular to the longitudinal direction of said body on a circumferential surface of said body.

7. Apparatus for weaving a three-dimensional article in accordance with claim 4, wherein each said carrier member has a through hole in the center thereof, and a pair of spring means are contained in said through hole, one end of said spring means being fixed to said through hole, said fibers are positioned respectively on both sides of each said carrier member, while being connected with other ends of said spring means respectively, said apparatus further comprising:

a pair of fiber supporting means provided on both sides of said weaving means to support the other ends of said fibers so that said fibers are stretched toward the both sides of said weaving means; and takeup means applying tension to said fibers through said fiber supporting means so that said fibers are stretched.

8. Apparatus for weaving a three-dimensional article in accordance with claim 7, said apparatus further comprising reed means provided between said weaving means and said fiber supporting means to tighten the woven fabric of said three-dimensional article woven aricle woven by said weaving means.

9. Apparatus for weaving a three-dimensional article in accordance with claim 4, wherein:

each said carrier member has a through hole for passing through each said fiber, said apparatus further comprising:

a plurality of bobbins provided on one side of said weaving means to wind said fibers;

means for rewinding said fibers toward said bobbins;

fiber bundling guide means provided between said bobbins and said weaving means for bundling said fibers withdrawn from said bobbins and then causing said fibers to pass through holes of said carrier members respectively;

clamping means provided on the other side of said weaving means to clamp a part of a three-dimensional article woven with said weaving means so that a woven fabric of said three-dimensional article can not be released; and transferring means provided on the other side of said weaving means to transfer said three-dimensional article in the direction away from said bobbins;

said control means further comprising:

ninth control means for driving said first and second guide means and said weaving means in the weaving drive direction determined by said first to eighth control means, in order to weave a pair of three-dimensional articles, whose weaving direction is opposite each other, on the both sides of said weaving means;

tenth control means for transferring said three-dimensional articles by a prescribed length in the direction away from said bobbins with said tranferring means, after completing a control operation of said ninth control means;

eleventh control means for driving said first and second guide means and said weaving means in the opposite direction to the weaving drive direction determined by said to first to eighth control means, respectively, in order to, on said clamping means side, weave a three-dimensional article whose weaving direction is opposite to that of said three-dimensional article woven by said tenth control means, while releasing said three-dimensional article of said bobbins side, after completing a control operation of said tenth control means; and twelfth control means for transferring said three-dimensional articles of said clamping means side by a prescribed length in the direction away from said bobbins by said transferring means, after completing a control operation of said eleventh control means.

10. Apparatus for weaving a three-dimensional article in accordance with claim 9.

said apparatus further comprising reed means provided between said weaving means and said clamping means to tighten the woven fabric of said three-dimensional article woven by said weaving means.

11. Apparatus for weaving a three-dimensional article in accordance with claim 8 or 10, wherein said reed means includes a reed body having at least one rod-shaped member, said reed body being driven along the fiber axis direction of said fibers.

12. Apparatus for weaving a three-dimensional article in accordance with claim 8 or 10, wherein said reed means is a jet blower for blowing high pressure gas.

13. A method according to claim 1, further comprising the step of:

tighening the fibers by use of a reed means.

* * * * *